US008774675B2

(12) United States Patent
Fukuda

(10) Patent No.: US 8,774,675 B2
(45) Date of Patent: Jul. 8, 2014

(54) COVERS OPENING/CLOSING SEQUENCE REGULATION SYSTEM AND METHOD AND IMAGE FORMATION APPARATUS USING SAME

(75) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 258 days.

(21) Appl. No.: 13/419,773

(22) Filed: Mar. 14, 2012

(65) Prior Publication Data

US 2012/0237254 A1 Sep. 20, 2012

(30) Foreign Application Priority Data

Mar. 15, 2011 (JP) ..... 2011-056330

(51) Int. Cl.
*G03G 15/00* (2006.01)

(52) U.S. Cl.
USPC ..... 399/110

(58) Field of Classification Search
CPC ..... G03G 21/16; G03G 21/1623; G03G 21/1633; G03G 21/1638; G03G 2215/00544; G03G 2221/16; G03G 2221/1675; G03G 2221/1687; G03G 2221/169
USPC ..... 399/107, 110, 124, 125
See application file for complete search history.

(56) References Cited

U.S. PATENT DOCUMENTS

| | | | | |
|---|---|---|---|---|
| 6,125,251 | A * | 9/2000 | Shiraishi et al. | 399/124 |
| 7,379,687 | B2 * | 5/2008 | Kawasumi | 399/110 |
| 7,386,252 | B2 * | 6/2008 | Portig et al. | 399/110 |
| 7,706,719 | B2 * | 4/2010 | Kiyama | 399/110 |
| 8,126,356 | B2 * | 2/2012 | Watanabe et al. | 399/110 |
| 8,331,826 | B2 * | 12/2012 | Minaminaka | 399/110 |

FOREIGN PATENT DOCUMENTS

JP 11-296048 A 10/1999

* cited by examiner

*Primary Examiner* — William J Royer
(74) *Attorney, Agent, or Firm* — Marvin A. Motsenbocker; MOTS Law, PLLC

(57) ABSTRACT

A covers opening/closing sequence regulation system includes a first cover and a second cover openably and closably attached to a housing. The first and second covers are provided in a way that the first cover becomes openable and closable while the second cover is in a fully-closed state, and that the second cover becomes unable to be fully-closed from an opened state while the first cover is in a fully-closed state. A regulation mechanism is configured to stop the first cover in a spaced-out position, which is spaced out from a fully-closed position of the first cover, in an operation of closing the first cover toward the fully-closed position with the second cover being in an opened state. The second cover is openable and closable while the first cover is in the spaced-out position.

20 Claims, 19 Drawing Sheets

COVERS OPENING/CLOSING SEQUENCE REGULATION SYSTEM AND METHOD AND IMAGE FORMATION APPARATUS USING SAME

CROSS REFERENCE TO RELATED APPLICATIONS

This application claims priority based on 35 USC 119 from prior Japanese Patent Application No. 2011-056330 filed on Mar. 15, 2011, entitled "COVERS OPENING/CLOSING SEQUENCE REGULATION SYSTEM, COVER OPENING/CLOSING SEQUENCE REGULATION METHOD, AND IMAGE FORMATION APPARATUS USING COVERS OPENING/CLOSING SEQUENCE REGULATION SYSTEM", the entire contents of which are incorporated herein by reference.

BACKGROUND OF THE INVENTION

1. Field of the Invention

The present disclosure relates to an opening and closing (opening/closing) sequence regulation system and method, and an image formation apparatus using the covers opening/closing sequence regulation system.

2. Description of the Related Art

Some conventional image formation apparatuses, such as printers, copying machines, facsimile machines, scanners, and multi-function printers (MFPs) include a printer section and a scanner section and are provided with a front cover and a side cover. The opening-end portions of the front and side covers overlap each other because of the necessity of maintenance services and the like. Such image formation apparatuses are provided with an opening/closing structure configured to regulate the opening/closing sequence of the front cover and the side cover in order that the maintenance services and the like can be properly provided (see Japanese Patent Application Publication No. Hei 11-296048, Paragraphs 0009 to 0016, for example).

SUMMARY OF THE INVENTION

If the opening/closing sequence of the covers is followed wrongly, the image formation apparatuses in the prior art require more work to open and close these covers than unnecessary.

An object of an embodiment of the invention is to enhance the operability in opening/closing the covers.

A first aspect of the invention is a covers opening/closing sequence regulation system including: a first cover openably and closably attached to a housing; a second cover openably and closably attached to the housing, wherein the first and second covers are provided such that the first cover becomes openable and closable while the second cover is in a fully-closed state, and the second cover becomes unable to be fully-closed from an opened state while the first cover is in a fully-closed state; and a regulation mechanism configured to stop the first cover in a spaced-out position, which is a position spaced out from a fully-closed position of the first cover, in an operation of closing the first cover toward the fully-closed position with the second cover in an opened state, wherein the second cover is openable and closable while the first cover is in the spaced-out position.

A second aspect of the invention is an opening/closing sequence regulation method for an apparatus including: a first cover; a second cover; and a structure configured to allow the first cover to be opened and closed while the second cover is in a fully-closed state, and not to allow the second cover to be opened or closed while the first cover is in a fully-closed state. The method includes: a step of stopping the first cover in a spaced-out position, which is a position spaced out from a fully-closed position of the first cover, in an operation of closing the first cover toward the fully-closed position with the second cover being in an opened state, wherein the second cover is openable and closable while the first cover is in the spaced-out position.

A third aspect of the invention is an image formation apparatus including the covers' opening/closing sequence regulation system according to the first aspect.

The foregoing aspects enhance the operability of opening/closing the covers.

BRIEF DESCRIPTIONS OF THE DRAWINGS

DETAILED DESCRIPTION OF EMBODIMENTS

Figure 1:
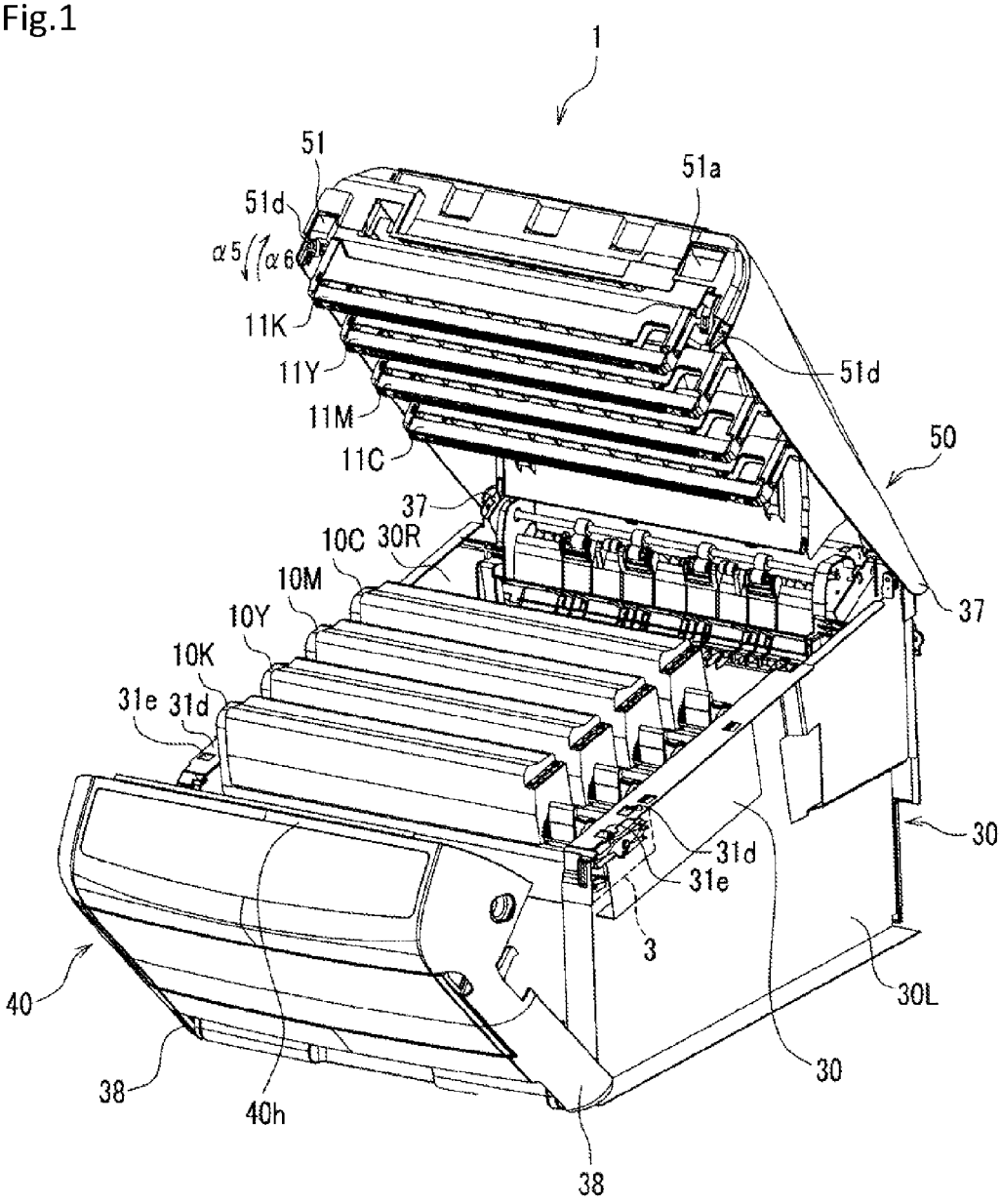
FIG. 1 is a perspective view of an external appearance of an image formation apparatus of a first embodiment with its front and top covers opened.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

Configuration of Image Formation Apparatus of the First Embodiment

Descriptions are hereinbelow provided for a configuration of an image formation apparatus of a first embodiment by referring to FIG. 1. FIG. 1 is a perspective view of an external appearance of an image formation apparatus 1 of the first embodiment with front cover 40 as a first cover and top cover 50 as a second cover opened.

Figure 2:
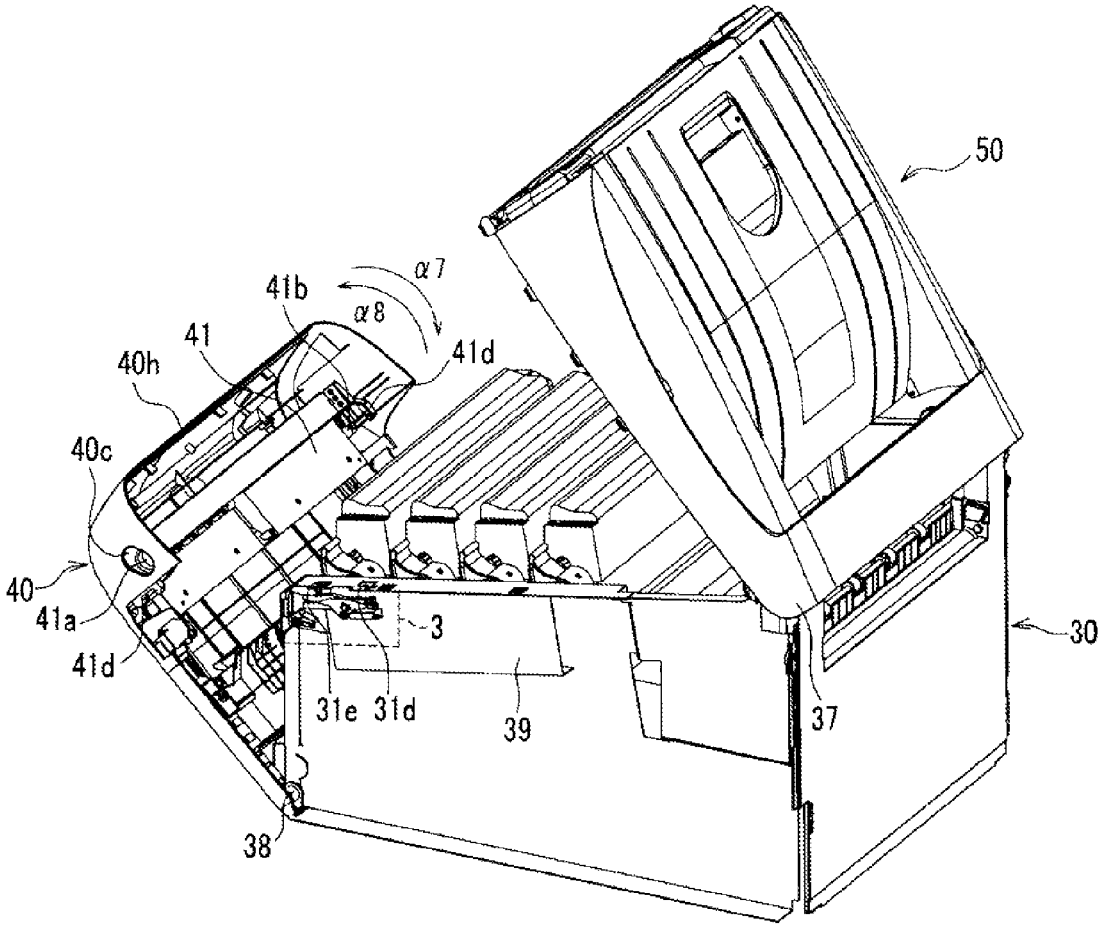
FIG. 2 is a perspective view of another external appearance of the image formation apparatus of the first embodiment with its front and top covers opened.
Figure 3:
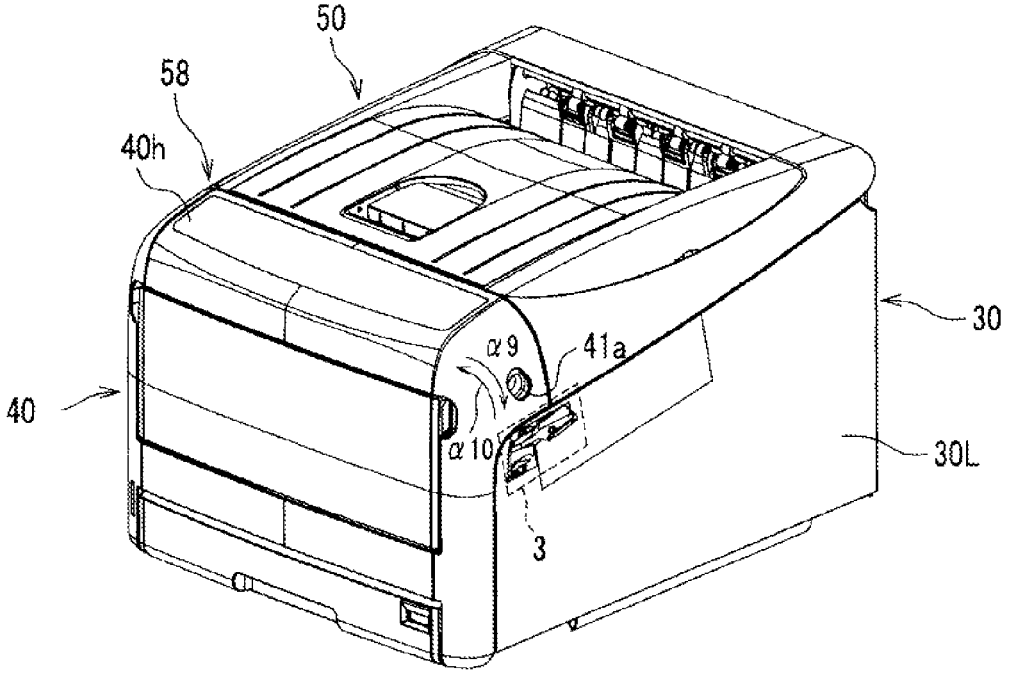
FIG. 3 is a perspective view of an external appearance of the image formation apparatus of the first embodiment with its front and top covers closed.
Figure 4:
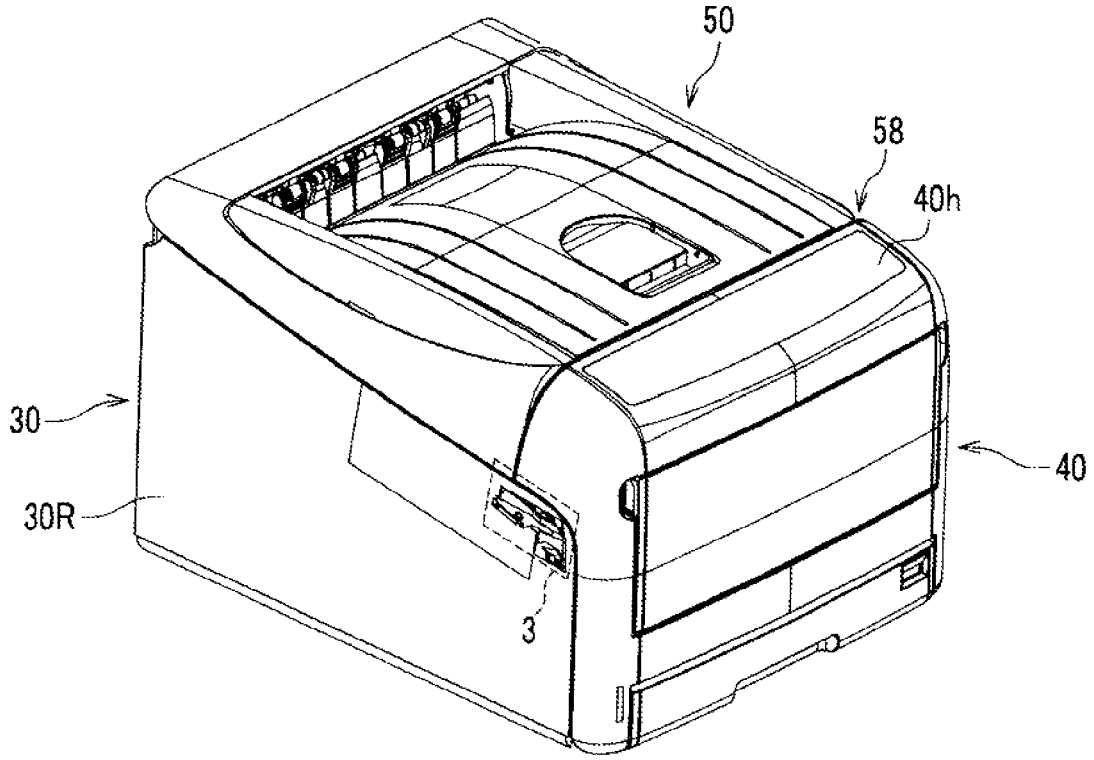
FIG. 4 is a perspective view of another external appearance of the image formation apparatus of the first embodiment with its front and top covers closed.
Figure 5:
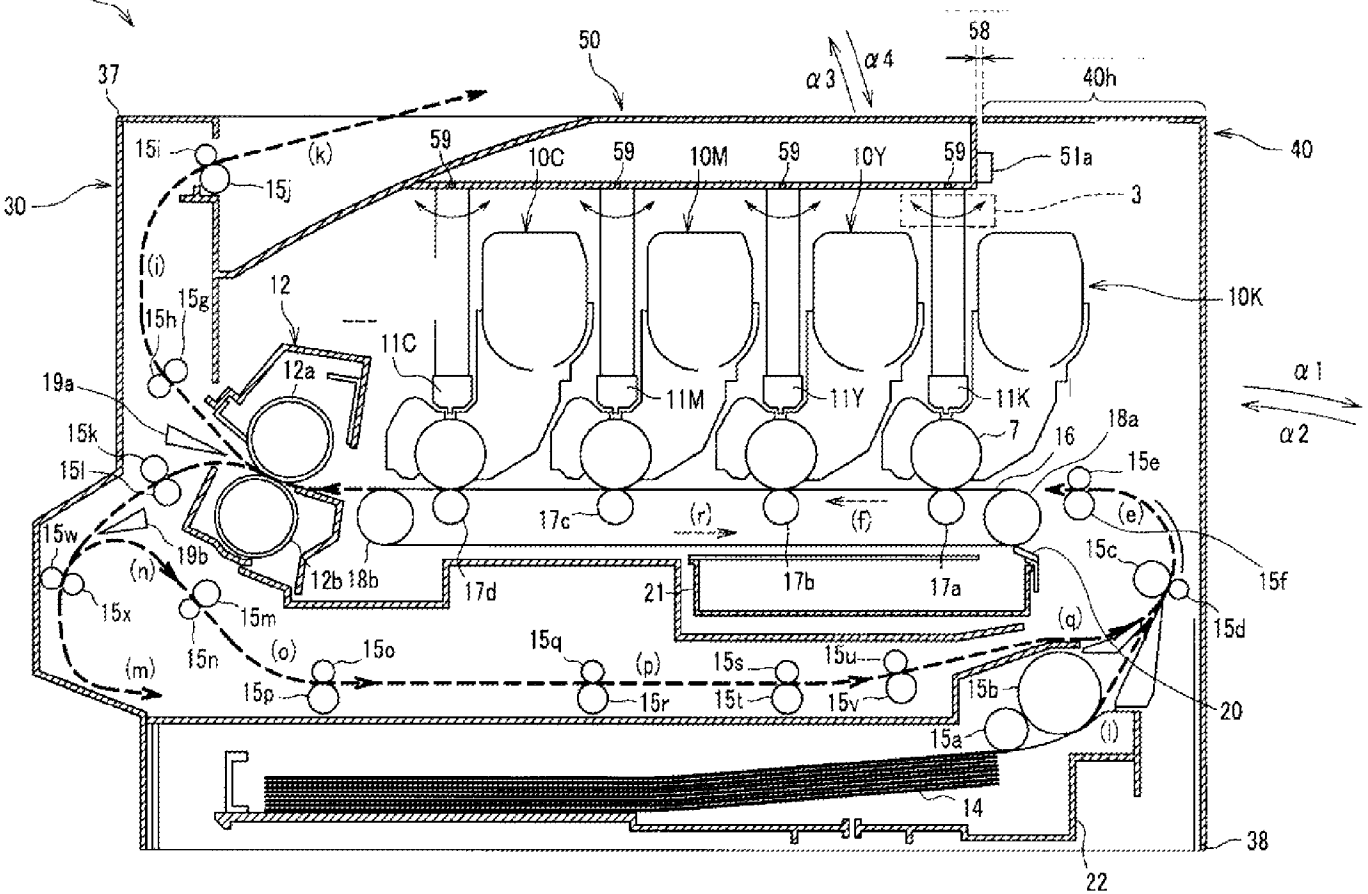
FIG. 5 is a longitudinal cross-sectional view of the image formation apparatus of the first embodiment with its front and top covers closed.

FIGS. 2 to 11 are referred to depending on the necessity for the purpose of explaining components of the image formation apparatus 1 shown in FIG. 1 in detail. FIG. 2 is a perspective view of another external appearance of image formation apparatus 1 of the first embodiment with front cover 40 and top cover 50 opened. FIGS. 3 and 4 are, respectively, a perspective view of an external appearance of, and a perspective view of another external appearance of, image formation apparatus 1 shown in FIG. 1 with front cover 40 and top cover 50 closed. Furthermore, FIG. 5 is a longitudinal cross-sectional view of image formation apparatus 1 shown in FIG. 1 with front cover 40 and top cover 50 closed. The other drawings are explained whenever deemed necessary.

<Image Formation Apparatus>

Referring to FIG. 1, image formation apparatus 1 of the first embodiment is, for example, a printer, a copying machine, a facsimile machine, a scanner, or a multi-function printer. The image formation apparatus 1 includes a printer section and a scanner section. Descriptions are provided for this embodiment with the assumption that image formation apparatus 1 is a printer.

In FIG. 1, image formation apparatus 1 is a tandem color printer capable of performing electrophotographic printing on the two sides of recording sheet 14 (see FIG. 5). Image formation apparatus 1 includes four development units 10 (10K, 10Y, 10M, 10C), four LED heads 11 (11K, 11Y, 11M, 11C) respectively as four light-exposure units, housing 30, front cover 40, top cover 50, and opening/closing sequence regulation system 3. In this respect, letters K, Y, M, C, which represent their respective colors, correspond to black, yellow, magenta and cyan. Detailed descriptions are hereinbelow provided for components of image formation apparatus 1.

<Development Units>

With regard to development units 10, four color development units 10K, 10Y, 10M, 10C, which are filled with their respective toners as developers, are arranged in a conveyance direction. Each development unit 10 is configured to form a developer image by developing an electrostatic latent image to be formed by light-exposure. A toner cartridge installed in each development unit 10 is designed to be detachable from image formation apparatus 1.

<LED Heads>

LED heads 11 as the light-exposure units are single-crystal thin-film light-emitting elements which are arranged in a line. Each LED head 11 is configured to form the electrostatic latent image by light-exposing its corresponding photosensitive drum 7 (see FIG. 5) as an image carrier in accordance with printing data. LED heads 11 are installed inside top cover 50, and are designed to be swingable, respectively, about fulcrum parts 59 (see FIG. 5 and FIG. 6) which are provided on an inner lateral surface of top cover 50.

<Housing>

Housing 30 is shaped like a box, as shown in FIG. 1 and FIG. 2. In this respect, a lateral plate of housing 30 which is on the left when facing forward is named as side plate 30L, and another lateral plate of housing 30 which is on the right when facing forward is named as side plate 30R.

Openings 31*d*, 31*e* are made in the upper surface of each of side plate 30L and side plate 30R. Plate 39 is fixed to side plate 30L with a certain space in-between. Incidentally, plate 39 is fixed to side plate 30R as well.

<Front Cover>

Returning to FIG. 1, front cover 40 as the first cover is that which is attached to the front of image formation apparatus 1. One end of front cover 40 is pivotally supported by fulcrum parts 38, respectively, of side plate 30L and side plate 30R, and front cover 40 turns about fulcrum parts 38. This makes the other end of front cover 40 openable.

The front extremity portion (free end portion) of front cover 40 is formed, with front cover 40 closed, in a shape which makes the front extremity portion extend from the front end to the rear end of housing 30 over housing 30. This front extremity portion is referred to as upper extending portion 40*h* (see FIG. 3). In addition, the boundary between upper extending portion 40*h* of front cover 40 and top cover 50 (the point at which front cover 40 and top cover 50 are separated from each other) is referred to as separation point 58 (see FIG. 3).

Upper extending portion 40*h* is formed to extend up to a position above development unit 10K (see FIG. 5). This enables a toner cartridge installed in development unit 10K to be replaced with front cover 40 opened, and with top cover 50 closed. This aims at enabling the toner cartridge installed in development unit 10K to be replaced easily with consideration given to a fact that in general printers, the toner for black (K) is consumed more than the toners for the other colors (Y, M, C).

It should be noted that the toner cartridges installed respectively in development units 10Y, 10M, 10C, except for the toner cartridge for black (K), are replaced with both front cover 40 and top cover 50 opened. In addition, paper sheet jam, i.e., a situation in which paper sheet 14 is jammed in image formation apparatus 1, is solved with both front cover 40 and top cover 50 opened as well.

Next, descriptions are provided for a lock mechanism configured to catch front cover 40 in a fully-closed position (see FIGS. 3 and 4). This lock mechanism (see FIG. 2) includes: hook parts 41*d* movably provided to front cover 40; and openings 31*e* provided to housing 30. Once hook parts 41*d* respectively enter openings 31*e*, front cover 40 is locked in the fully-closed position. Once hook parts 41*d* respectively come off openings 31*e*, front cover 40 is released from its lock in the fully-locked position.

The lock mechanism is explained as follows. As shown in FIG. 2, lock lever 41 is placed on the inner side of upper extending portion 40*h* and is configured to be turnable about fulcrum part 41*b* in an α7 direction or in an α8 direction. Paired left and right hook parts 41*d* are respectively placed in the two sides of lock lever 41. Hook parts 41*d* are those configured to connect front cover 40 to side plates 30L, 30R of housing 30 when front cover 40 is in the fully-closed position.

Opening 40*c* is provided in upper extending portion 40*h*. Manipulation part 41*a* of lock lever 41 is exposed to the outside of upper extending portion 40*h* through opening 40*c*. When an operator manipulates manipulation part 41*a*, lock lever 41 turns in an α7 direction or in an α8 direction, and hook parts 41*d* also turn in the α7 direction or in the α8 direction in cooperation with lock lever 41.

Once the operator pulls down manipulation part 41*a* in an α9 direction (see FIG. 3) with front cover 40 fully closed, hook parts 41*d* turns in the α7 direction, and are attached to openings 31*e* of side plates 30L, 30R by insertion. By this, front cover 40 is connected to side plates 30L, 30R of housing 30. In other words, front cover 40 is locked in the fully-closed position. Otherwise, once the operator pulls up manipulation part 41*a* in an α10 direction (see FIG. 3), hook parts 41*d* turn in the α8 direction, and come out of openings 31*e* of side plates 30L, 30R. Thereby, front cover 40 is released from its lock in the fully-closed position, and becomes openable.

<Top Cover>

Returning to FIG. 1, top cover 50 as the second cover is that which is attached to the upper side of image formation apparatus 1. One end of top cover 50 is pivotally supported by fulcrum parts 37, respectively, of side plate 30L and side plate 30R. The turn of the one end of top cover 50 about fulcrum parts 37 enables the other end of top cover 50, which is a free end, to be opened.

The free end (front end portion) of top cover 50 is formed to extend up to a position above LED head 11K, but is not formed in a position above development unit 10K (see FIG. 5). This aims at enabling the toner cartridge installed in development unit 10K to be replaced with front cover 40 opened and with top cover 50 closed, as described above.

Next, descriptions are provided for a lock mechanism configured to catch top cover 50 in the fully-closed position (FIGS. 3 and 4). This lock mechanism includes: hook parts 51*d* movably attached to top cover 50; and openings 31*d* provided in housing 30. Once hook parts 51*d* respectively enter openings 31*d*, top cover 50 is locked in the fully-closed position. Once hook parts 51*d* respectively come out of openings 31*d*, top cover 50 is released from its lock in the fully-closed position.

Detailed descriptions are hereinbelow provided for the lock mechanism of top cover 50 by referring to FIGS. 1 and 2. Lock lever 51 and manipulation part 51*a* for lock lever 51 are placed in the free end portion (front end portion) of top cover 50. Paired left and right hook parts 51*d* are placed in the two sides of lock lever 51, respectively. Hook parts 51*d* are those configured to connect top cover 50 to side plates 30L, 30R of housing 30 when top cover 50 is in the fully-closed position. When the operator manipulates manipulation part 51*a*, lock lever 51 turns in an α5 direction or in an α6 direction, and hook parts 51*d* turn in the α5 direction or in the α6 direction in cooperation with lock lever 51 as well.

Once the operator turns hook parts 51*d* in the α5 direction with top cover 50 closed, hook parts 51*d* are respectively attached to openings 31*d* of side plates 30L, 30R by insertion. By this, top cover 50 is locked in the fully-closed position. Otherwise, once the operator turns hook parts 51*d* in the α6 direction, hook parts 51*d* respectively come out of openings 31*d* of side plates 30L, 30R. Thereby, the connection between top cover 50 and side plates 30L, 30R is released, i.e. top cover 50 is released from its lock in the fully-closed position, and becomes openable.

Manipulation part 51*a* of lock lever 51 is covered by, and is hidden behind, upper extending portion 40*h* of front cover 40 when both front cover 40 and top cover 50 are closed (see FIG. 3). For this reason, the operator cannot see or manipulate manipulation part 51*a*. That is to say, front cover 40 puts the front end surface of top cover 50 in a state of being shielded.

In other words, this embodiment includes the structure which enables front cover 40 to be opened and closed while top cover 50 is fully closed, and which makes top cover 50 incapable of being opened and closed while front cover 40 is fully closed.

For this reason, the operator, first of all, needs to open front cover 40 in order to open top cover 50. To this end, when opening both front cover 40 and top cover 50, image formation apparatus 1 regulates the opening sequence of opening front cover 40 first and then opening top cover 50.

<Opening/Closing Sequence Regulation System>

Figure 6:
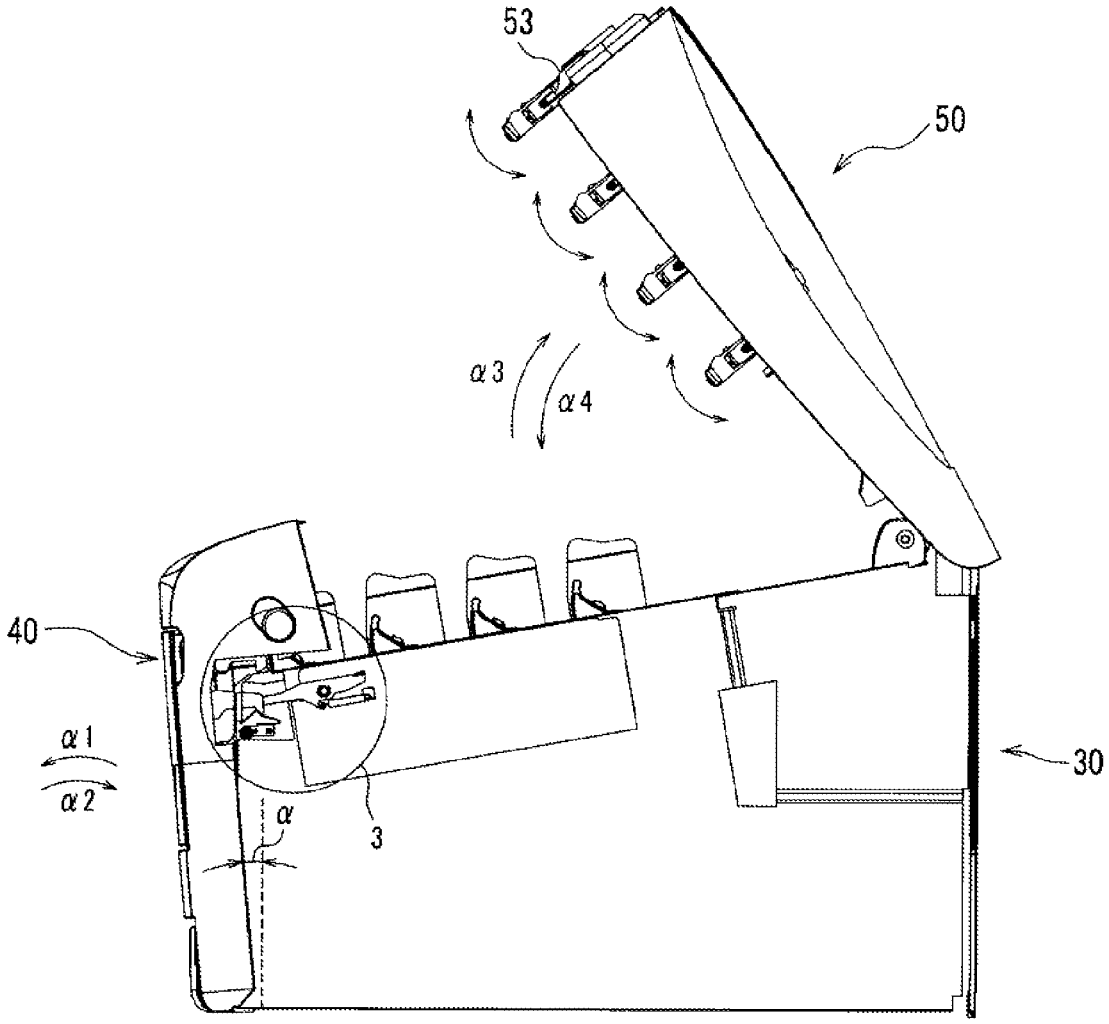
FIG. 6 is a side view of an external appearance of the image formation apparatus of the first embodiment with a closing operation of its front cover restricted, and with its top cover opened.
Figure 7:
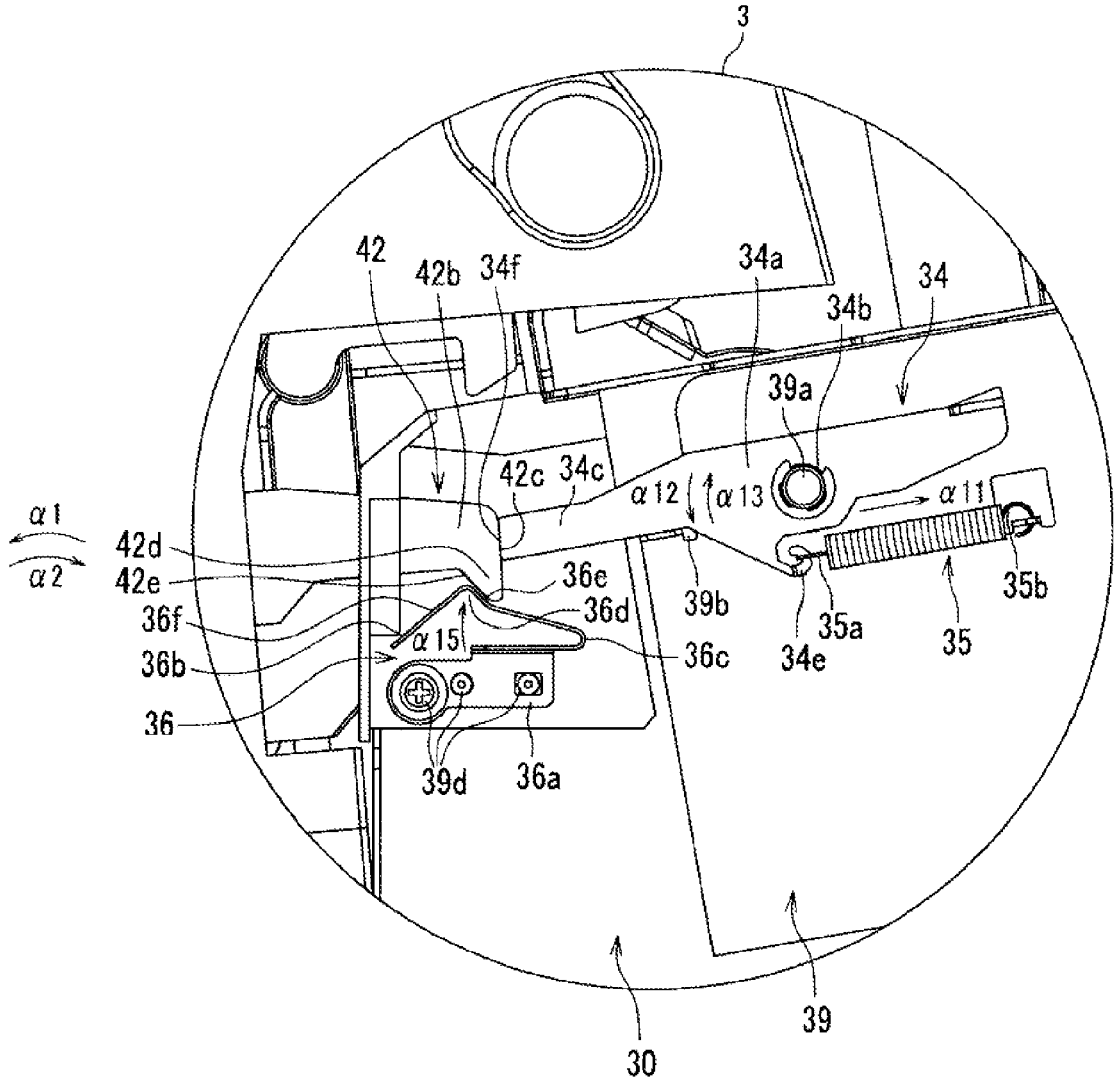
FIG. 7 is an enlarged side view of an external appearance of a main part of the image formation apparatus of the first embodiment with the closing operation of its front cover restricted, and with its top cover opened.

Referring to FIG. 6 and FIG. 7, descriptions are provided for opening/closing sequence regulation system 3 configured to regulate the opening/closing sequence of front cover 40 and top cover 50. FIG. 6 is a side view of an external appearance of image formation apparatus 1 of the first embodiment with the closing operation of front cover 40 restricted, and with its top cover opened. FIG. 7 is an enlarged side view of an external appearance of a main part of image formation apparatus 1 shown in FIG. 6.

Opening/closing sequence regulation system 3 configured to regulate the opening/closing sequence of front cover 40 and top cover 50 includes regulation mechanisms and catch mechanisms. Each regulation mechanism of opening/closing sequence regulation system 3 includes: protrusion 42 fixedly attached to front cover 40; lever 34 as a first turnable member which is turnably attached to plate 39 fixedly attached to housing 30; and tensile spring 35 as a first bias member. Each catch mechanism of opening/closing sequence regulation system 3 includes: projection 42*d* as an engagement part which is formed in a lower portion of protrusion 42; and plate spring 36 as a catch part which is fixedly attached to housing 30. Detailed descriptions are provided as follows.

Referring to FIG. 7, protrusion 42 is fixedly attached to front cover 40, and juts out toward housing 30. Front extremity portion 42*b* of protrusion 42 comes into contact with front extremity portion 34*c* of lever 34. A portion of front extremity portion 42*b* which comes in contact with front extremity portion 34*c* of lever 34 is referred to as contact portion 42*c*. In addition, projection 42*d* is formed in the lower portion of the protrusion 42. Projection 42*d* comes into contact with plate spring 36. Incidentally, a portion of projection 42*d* which comes into contact with plate spring 36 is referred to as contact portion 42*e*.

Fulcrum part 39*a* fixedly attached to plate 39 is inserted in through-hole 34*b* provided in main body portion 34*a* of lever 34, and thereby lever 34 is pivotally supported by fulcrum part 39*a* in such a manner as to be turnable about fulcrum part 39*a*. Lever 34 is turnable between a regulation position (bottom dead point) shown in FIG. 7 and a non-restriction position (top dead point) shown in FIG. 11. Lever 34 is connected to movable end portion 35*a* of tensile spring 35 via biased portion 34*e*. Fixed end portion 35*b* of tensile spring 35 is fixedly attached to plate 39.

Lever 34 turns in an α12 direction due to a biasing force working in an α11 direction which is produced by the stretching of tensile spring 35. Incidentally, the turn of lever 34 in the α12 direction is restricted by the contact of main body portion 34*a* into limiter part 39*b* which is formed in plate 39. Thereby, lever 34 does not turn beyond a position shown in FIG. 7 in the α12 direction.

Furthermore, front extremity portion 34*c* of lever 34 comes into contact with front extremity portion 42*b* of protrusion 42. Thereby, lever 34 stops front cover 40 (see FIG. 6) from further turning in the α2 direction with its thrust. Incidentally, a portion of front extremity portion 34*c* which comes into contact with protrusion 42 is referred to as contact portion 34*f*.

One end of plate spring 36 is fixed to the housing 30, and the opposite end of plate spring 36 is a free end. To put it specifically, main body portion 36*a* of plate spring 36 is tied up to housing 30 by use of screws 39*d*. Front extremity portion 36*b* of plate spring 36 is capable of providing displacement, that is to say, is a free end. When an upper portion of plate spring 36 is squeezed, a biasing force produced deforms portion 36*c* so to produce a biasing force in the α15 direction due to an elastic force produced by the deformation of portion 36*c*.

Projection 36*d* of plate spring 36 comes into contact with projection 42*d* of protrusion 42. Thereby, plate spring 36 checks the turn of front cover 40 in the al direction. Incidentally, a portion of projection 36*d* which comes into contact with protrusion 42 is referred to as contact portion 36*e*.

Inclined portion 36*f* formed in the neighborhood of front extremity portion 36*b* is formed in a way to makes it easy for projection 42*d* of protrusion 42 to go over inclined portion 36*f* when front cover 40 turns in the α2 direction and thus closes.

When front cover 40 is closed prior to top cover 50 in a sequence which is different from the opening/closing sequence, front extremity portion 42*b* of protrusion 42 collides against front extremity portion 34*c* of lever 34. Thereby, the turn of front cover 40 in the α2 direction is restricted in a spaced-out position (see FIG. 6) which is a position where front cover 40 is opened from the fully-closed position by an angle of α degrees.

Figure 8:
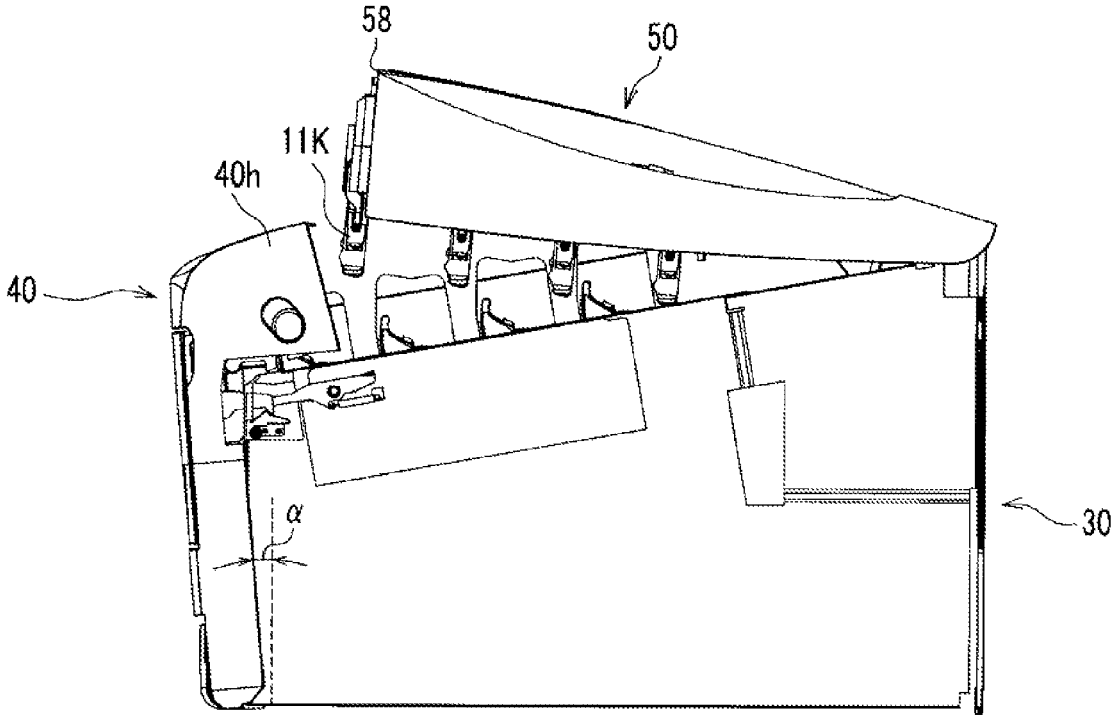
FIG. 8 is a diagram for explaining effects of an opening/closing sequence regulation system of the first embodiment.

The angle of α degrees is that which is determined in order to prevent LED head 11K from being damaged as a result of colliding against upper extending portion 40*h* of front cover 40 when, as shown in FIG. 8, top cover 50 is closed. If front cover 40 would advance to a position where an angle between front cover 40 and the fully-closed position is less than the angle of α degrees, LED head 11K would interfere with upper extending portion 40*h* of front cover 40 when top cover 50 is closed.

Figure 9:
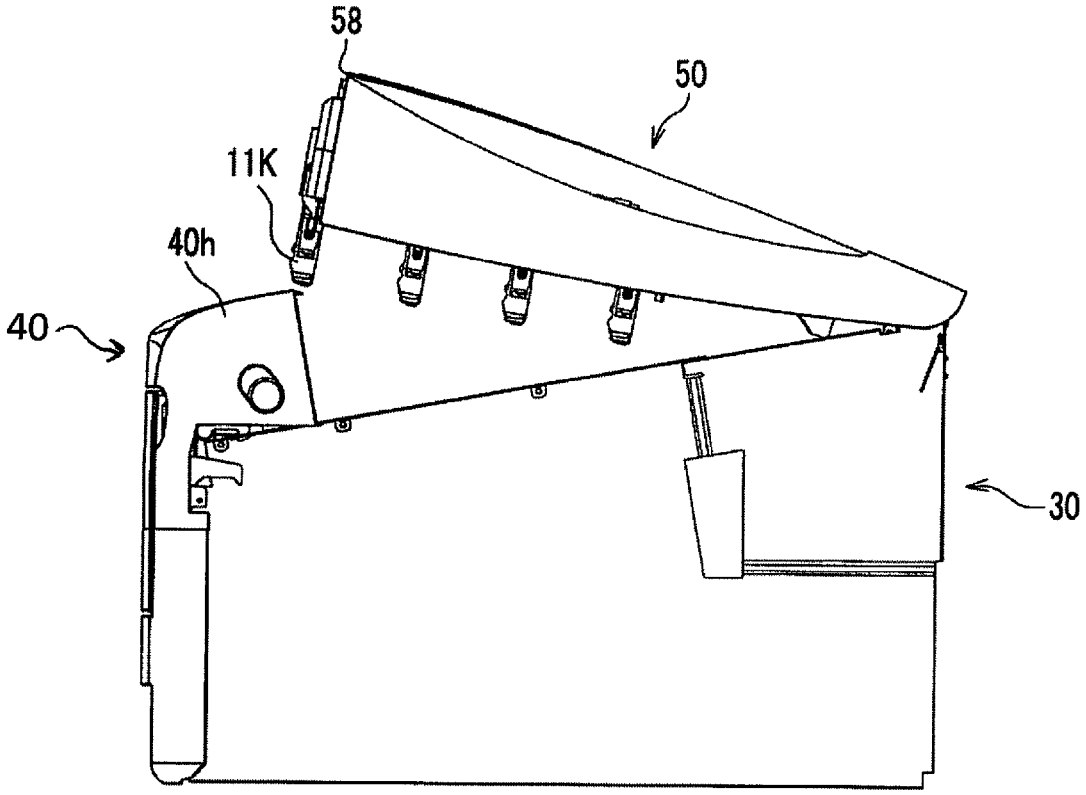
FIG. 9 is a diagram of a comparative example which shows an image formation apparatus that does not include an opening/closing sequence regulation system of the first embodiment, and is used to explain the effects of the opening/closing sequence regulation system of the first embodiment.

FIG. 9 is a diagram of a comparative example comparable with the image formation apparatus. FIG. 9 shows an image formation apparatus including no opening/closing sequence regulation system 3 of the first embodiment. Because the comparative example shown in FIG. 9 includes no regulation mechanism, front cover 40 is not stopped in the space-out position. For this reason, if top cover 50 is intended to be closed with front covet 40 already closed, LED head 11K interferes with upper extending portion 40*h* of front cover 40.

By this, front extremity portion 42*b* of protrusion 42 formed in front cover 40 is stopped by front extremity portion 34*c* of lever 34 with its thrust. This restricts the turn of front cover 40 in its closing direction (the α2 direction) in the spaced-out position which is spaced out from the fully-closed position of front cover 40. The state in which the turn of front cover 40 in the closing direction (the α2 direction) is restricted is hereinafter referred to as a "restricted state."

In addition, projection 42*d* of protrusion 42 formed in front cover 40 receives the biasing force from plate spring 36. Thereby, front cover 40 is caught in a manner difficult to turn in the opening direction (the al direction) in the space-out position in which the turn of front cover 40 in the closing direction (the α2 direction) is restricted. The state in which front cover 40 is caught in a manner difficult to turn in the opening direction (the α1 direction) is hereinafter referred to as a "caught state." In this respect, while front cover 40 (the first cover) is in the caught state, top cover 50 (the second cover) is openable/closable.

It should be noted that although in the embodiment, front cover 40 is caught in a manner difficult to turn in the opening direction (the α1 direction) in the spaced-out position in which the turn of front cover 40 in the closing direction (the α2 direction) is restricted, front cover 40 may be caught in a manner difficult to turn in the opening direction (the α1 direction) in some position between the spaced-out position and a position immediately before the fully-closed position of front cover 40. For example, front cover 40 may be caught in a manner difficult to turn in the opening direction (the al direction) in a position which is much further spaced out from the spaced-out position in the opening direction (the α1 direction).

Figure 10:
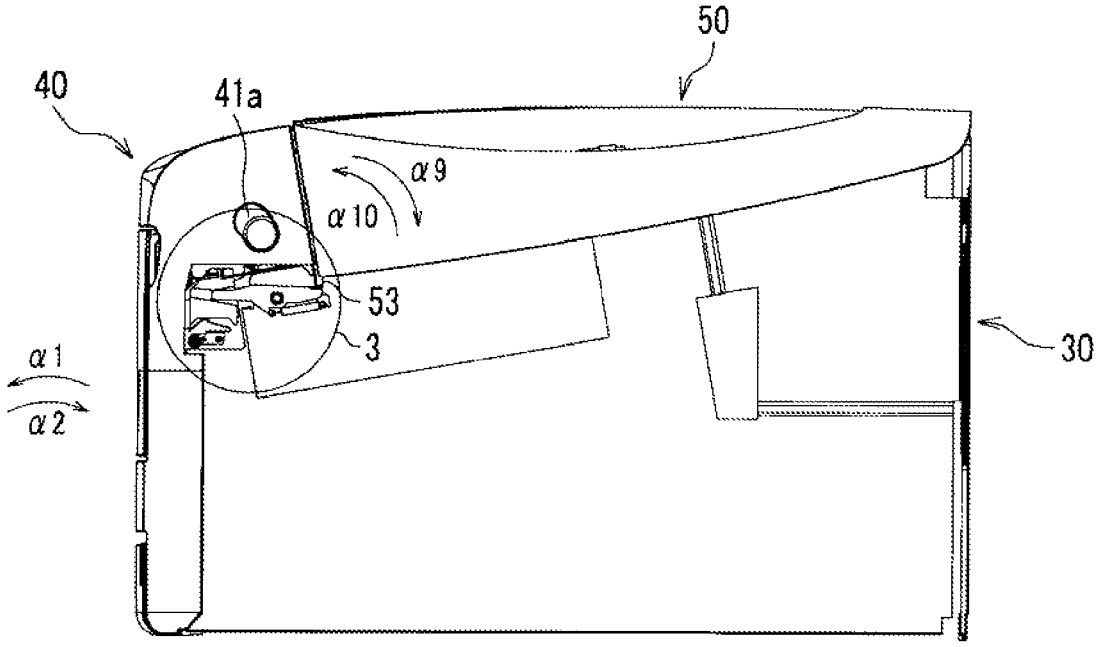
FIG. 10 is a side view of another external appearance of the image formation apparatus of the first embodiment with its front and top covers closed.
Figure 11:
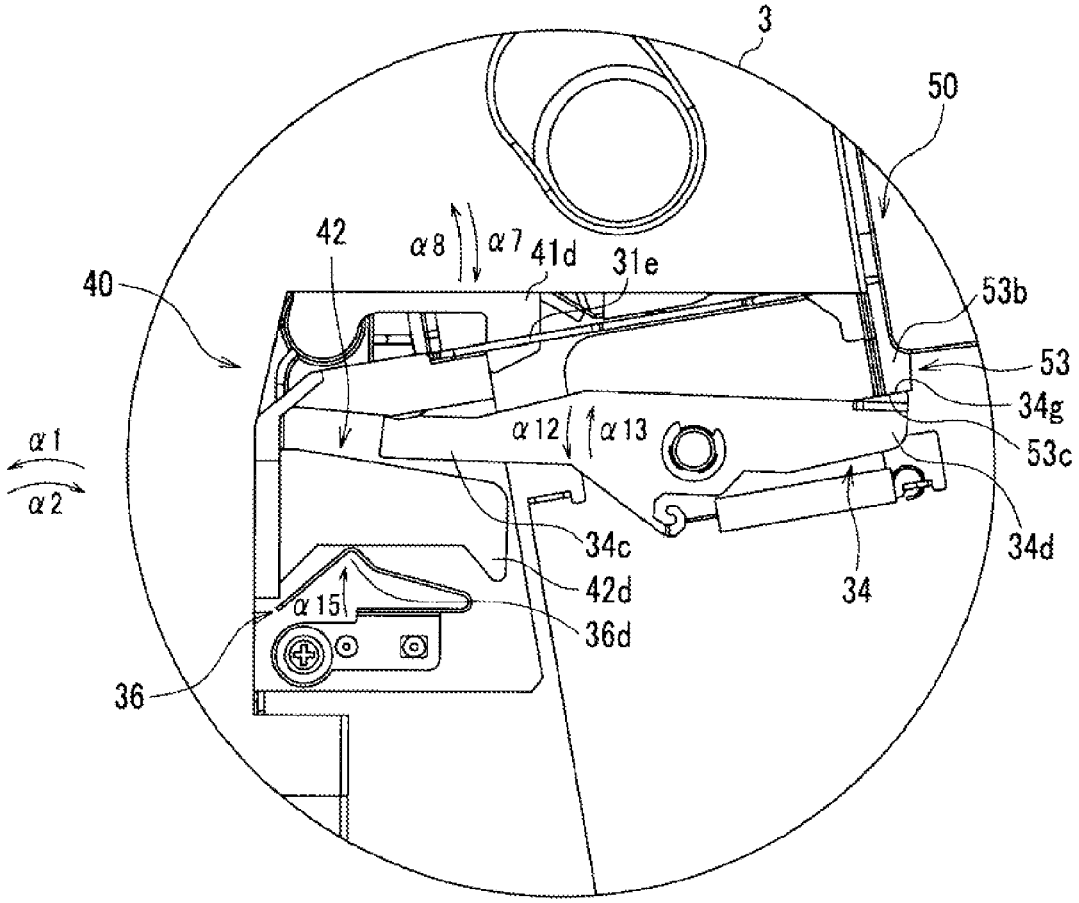
FIG. 11 is an enlarged side view of an external appearance of a main part of the image formation apparatus of the first embodiment with its front and top covers closed.

Next, referring to FIG. 6, the release of the restricted state is achieved by closing top cover 50. FIG. 10 and FIG. 11 show the state where the restricted state is released by closing top cover 50. Incidentally, FIG. 10 is a side view of an external appearance of image formation apparatus 1 of the first embodiment with front cover 40 and top cover 50 closed. FIG. 11 is an enlarged side view of an external appearance of a main part of image formation apparatus 1 shown in FIG. 10.

Referring to FIG. 11, protrusion 53 is fixedly attached to top cover 50. Front extremity portion 53*b* of protrusion 53 comes into contact with rear end portion 34*d* of lever 34. Incidentally, a portion of front extremity portion 53*b* which comes into contact with lever 34 is referred to as contact portion 53*c*, and a portion of rear end portion 34*d* which comes into contact with protrusion 53 is referred to as contact portion 34*g*.

Once top cover 50 is closed, front extremity portion 53*b* of protrusion 53 and rear end portion 34*d* of lever 34 come into contact with each other. Thereby, lever 34 receives the biasing force, and turns in an α13 direction. This causes lever 34 and protrusion 42 to come out of contact with each other, and front cover 40 becomes closable.

Next, referring to FIG. 5, descriptions are provided for components inside housing 30 included in image formation apparatus 1. In addition to what are already described above, housing 30 further includes: fixation unit 12, four transfer rollers 17 (17*a*, 17*b*, 17*c*, 17*d*), transfer belt 16, recording sheet conveyance rollers 15 (15*a*, 15*b*, 15*x*), drive rollers 18*a*, 18*b*, recording sheet travel guides 19*a*, 19*b*, transfer belt cleaning blade 20, waste developer tank 21, and recording sheet cassette 22. Descriptions are hereinbelow provided for each of these components of image formation apparatus 1.

<Transfer Rollers and Fixation Unit>

Transfer rollers 17*a*, 17*b*, 17*c*, 17*d* transfer development images, which are formed on photosensitive drums 7 in development units 10, respectively, to recording sheet 14 which is a printing medium. Fixation unit 12 includes heating roller 12*a* and pressure roller 12*b*. Fixation unit 12 fixes the developer images, which are transferred onto recording sheet 14, by heating them up to a predetermined temperature and pressing them.

<Recording Sheet Cassette, Recording sheet Conveyance Rollers, Transfer Belt and Drive Rollers>

Recording sheet cassette 22 contains one or more recording sheets 14. Recording sheet conveyance rollers 15 convey each recording sheet 14 from recording sheet cassette 22 to a delivery stacker. Transfer belt 16 is a belt member formed in an endless shape, and conveys recording sheet 14 to fixation unit 12. Drive rollers 18*a*, 18*b* are conveyance members configured to rotate transfer belt 16, and simultaneously function as cooler members configured to cool transfer belt 16 which is warmed by fixation unit 12. Incidentally, drive roller 18*b* is a driving roller, and drive roller 18*a* is a driven roller.

<Recording Sheet Travel Guides, Transfer Belt Cleaning Blade and Waste Developer Tank>

Recording sheet travel guides 19*a*, 19*b* are designed to rotationally move in order to change directions in which recording sheet 14 travels. Transfer belt cleaning blade 20 is provided under (or at the side of) drive roller 18*a*. Waste developer tank 21 is provided under drive roller 18*a* and transfer belt 16.

It should be noted that parenthesized lower-case alphabetical letters accompanying thick/thin dashed lines with arrows in FIG. 1 indicate conveyance paths of recording sheet 14, including conveyance paths for a duplex printing mode. To put it specifically, recording sheet 14 passes through path (l) from recording sheet cassette 22 and recording sheet conveyance rollers 15*a*, 15*b*, and reaches recording sheet conveyance rollers 15*c*, 15*d*. Recording sheet 14 further passes through conveyance path (e), and reaches recording sheet conveyance rollers 15*e*, 15*f*. While recording sheet 14 is being conveyed along the upper surface of transfer belt 16 in the direction shown by way of arrow (f) in FIG. 5, development units 10 and transfer rollers 17 respectively transfer the developer images onto the front surface of recording sheet 14. Thereafter, recording sheet 14 passes through fixation unit 12.

In the case of the duplex printing mode, recording sheet travel guide 19*a* directs recording sheet 14 toward recording sheet conveyance rollers 15*k*, 15*l*. Recording sheet 14 passes through recording sheet rollers 15*w*, 15*x* (conveyance path (m)) in accordance with the effect of recording sheet travel guide 19*b*. Thereafter, the rotations of recording sheet conveyance rollers 15*w*, 15*x*, between which the rear end of recording sheet 14 is held, are reversed, and the direction in which recording sheet 14 travels is changed by recording sheet travel guide 19*b*. Thereby, recording sheet 14 passes through conveyance path (n), and reaches recording sheet conveyance rollers 15*m*, 15*n*. Subsequently, recording sheet 14 passes through conveyance paths (o), (p), (q), and reaches recording sheet conveyance rollers 15*c*, 15*d* again. At this time, recording sheet 14 is reversed with its back surface face up. Recording sheet 14 passes through conveyance path (e) and recording sheet conveyance rollers 15*e*, 15*f*, and reaches transfer belt 16. Thereafter, development units 10 and transfer rollers 17 respectively transfer the development images onto the back surface of recording sheet 14 while the recording sheet 14 travels in the direction as shown by way of arrow (r) in FIG. 5. Fixation unit 12 fixes the development images which are transferred onto recording sheet 14.

Afterwards, recording sheet travel guide 19*a* rotationally moves, and recording sheet 14 is thereby directed toward recording sheet conveyance rollers 15*g*, 15*h*. After that, recording sheet 14 passes through conveyance path (i), and reaches recording sheet conveyance rollers 15*i*, 15*j*. Eventually, recording sheet 14 is delivered via conveyance path (k).

The descriptions for the components of the image formation apparatus of the first embodiment are concluded with this.

<<Operation of Image Formation Apparatus of First Embodiment>>

<Opening Operation of Front and Top Covers>

Referring to FIGS. 10 to 15, descriptions are hereinbelow provided for how front cover 40 as the first cover and top cover 50 as the second cover operate for their opening in image formation apparatus 1 of the first embodiment.

(Opening Operation of Front Cover)

First of all, referring to FIG. 10, when a paper sheet jam is solved, when any development unit 10 is replaced, or when the toner cartridge or the like installed in any development unit 10 is replaced, manipulation part 41*a* of lock lever 41 (see FIG. 2) is pulled up in the α10 direction. Thereby, hook parts 41*d* shown in FIG. 11 turn in the α8 direction, and are released from their lock. Once hook parts 41*d* are released from their lock, front cover 40 starts to turn in the α1 direction due to the biasing force of a torsion spring, which is not illustrated.

After front cover 40 turns by a particular angle, projection 42*d* of protrusion 42 comes into contact with projection 36*d* of plate spring 36, and front cover 40 stops its turn with plate spring 36 pushed down by protrusion 42. Once front cover 40 is turned in the al direction, starting in this state, by applying a force which is stronger than the biasing force of plate spring 36 in the α15 direction, projection 42*d* of protrusion 42 goes over projection 36*d* of plate spring 36, and front cover 40 enters into the opened state (see FIG. 12).

(Opening Operation of Top Cover)

Figure 12:
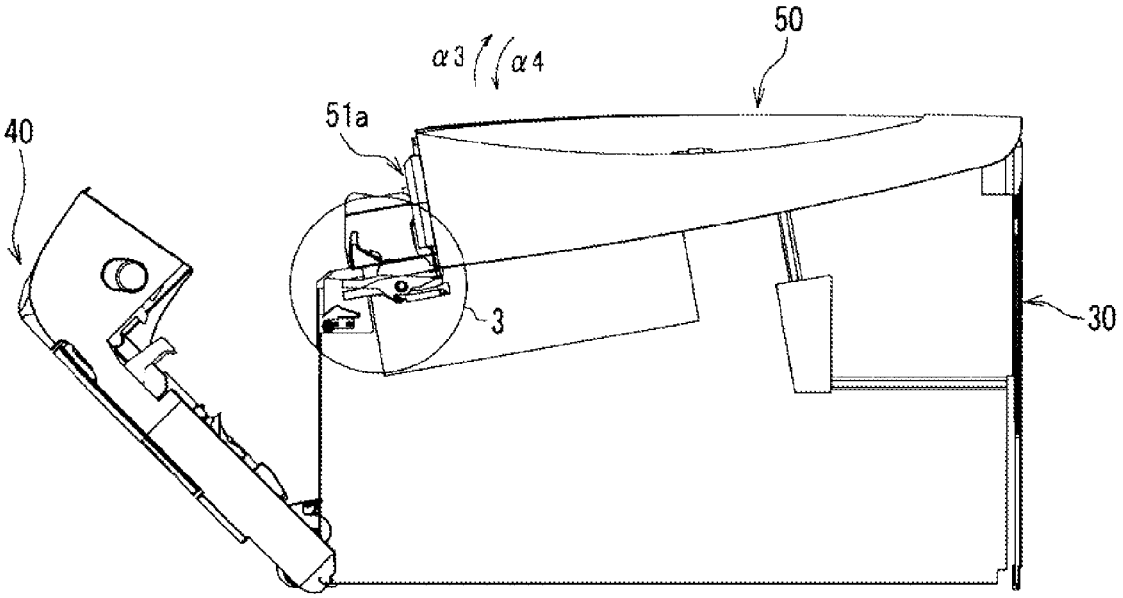
FIG. 12 is a side view of an external appearance of the image formation apparatus of the first embodiment with its front cover opened, and with its top cover closed.
Figure 13:
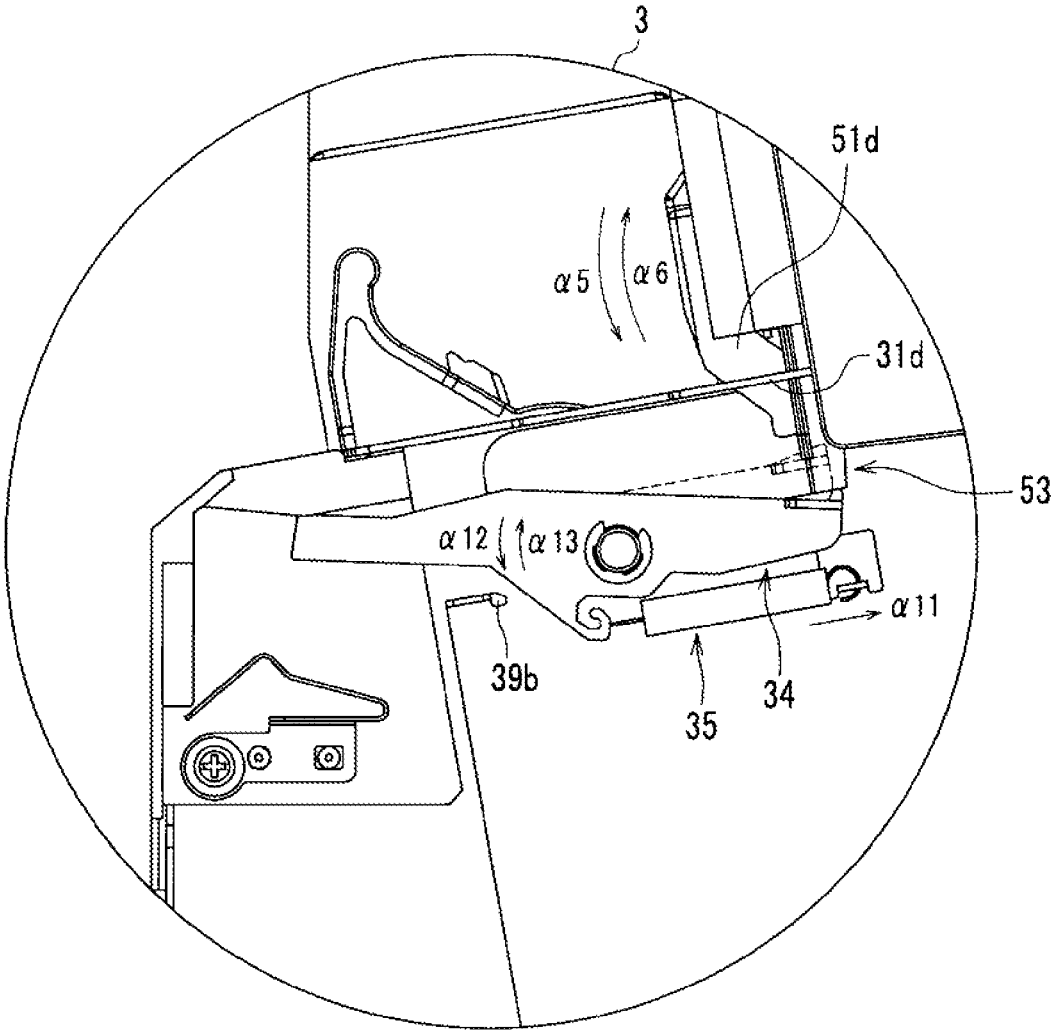
FIG. 13 is an enlarged side view of an external appearance of a main part of the image formation apparatus of the first embodiment with its front cover opened and with its top cover closed.

Next, referring to FIG. 12, once manipulation part 51*a* of lock lever 51 (see FIG. 1), which is exposed to the outside by opening front cover 40, is pushed down, hook parts 51*d* shown in FIG. 13 turn in an α6 direction, and hook parts 51*d* are released from their lock. Once the hook parts 51*d* are released from their lock, top cover 50 turns in an α3 direction due to the biasing force of a torsion spring, which is not illustrated. Thereby, top cover 50 enters into the opened state (see FIG. 14).

Referring to FIG. 12, in response to the turn of top cover 50 in the α3 direction, protrusion 53 and lever 34 come out of contact with each other, which are shown in FIG. 13. Thereby, lever 34 is set free from the biasing force of protrusion 53, and concurrently turns in an α12 direction due to the biasing force of tensile spring 35 in an all direction. After turning by a particular angle, lever 34 comes into contact with limiter part 39*b*, and stays still (see FIG. 15). The descriptions for how front cover 40 and top cover 50 in image formation apparatus 1 of the first embodiment operate for their opening are concluded with this.

<Closing Operation of Front and Top Covers>

Referring to FIGS. 6 to 15, descriptions are hereinbelow provided for how front cover 40 as the first cover and top cover 50 as the second cover operate for their closing in image formation apparatus 1 of the first embodiment. In this respect, descriptions are omitted for the closing operation carried out in a sequence in which the closing of top cover 50 is followed by the closing of front cover 40, because such a closing operation is pursued in a sequence which is reverse to the sequence described in the section entitled "Opening Operation of Front Cover and Top Cover," which is given above. The following descriptions are provided for the closing operation carried out in a sequence in which the closing of front cover 40 is followed by the closing of top cover 50.

(Closing Operation of Front Cover)

Figure 14:
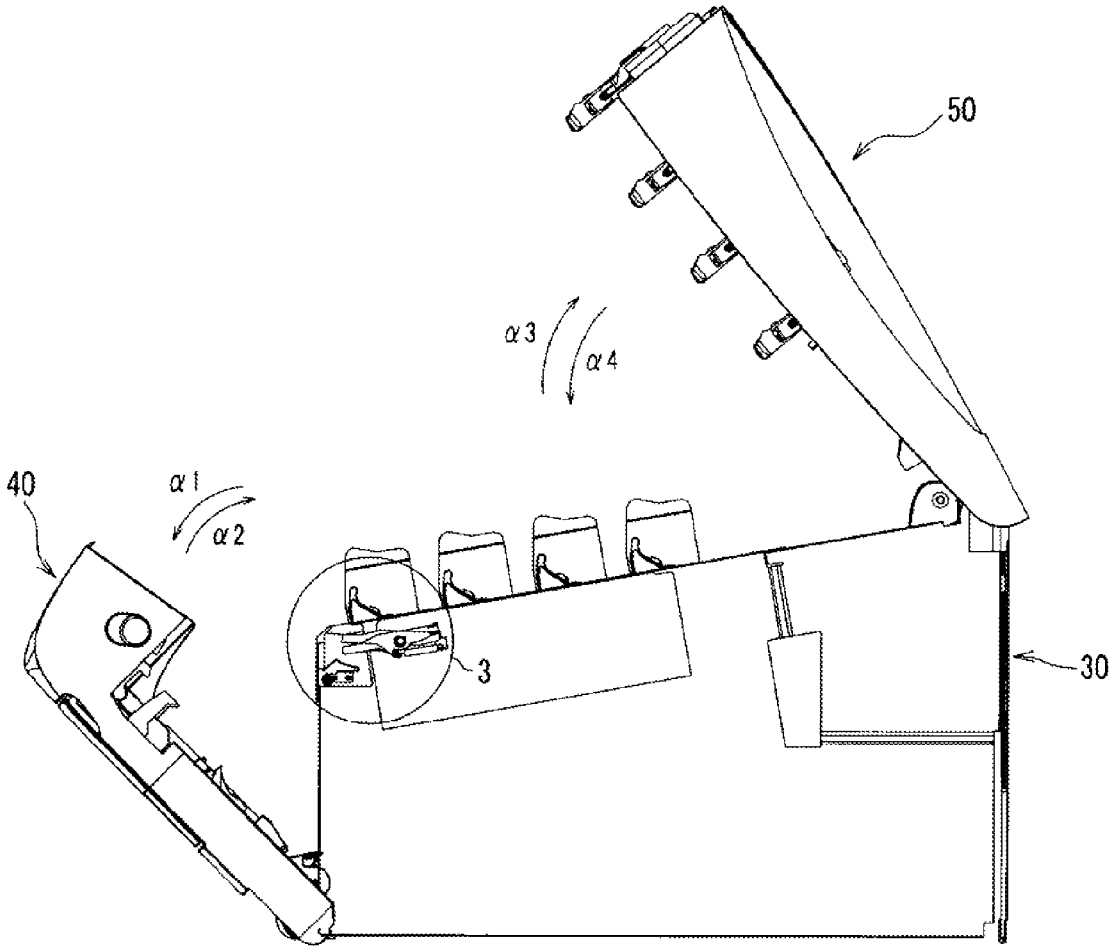
FIG. 14 is a side view of an external appearance of the image formation apparatus of the first embodiment with its front and top covers opened.
Figure 15:
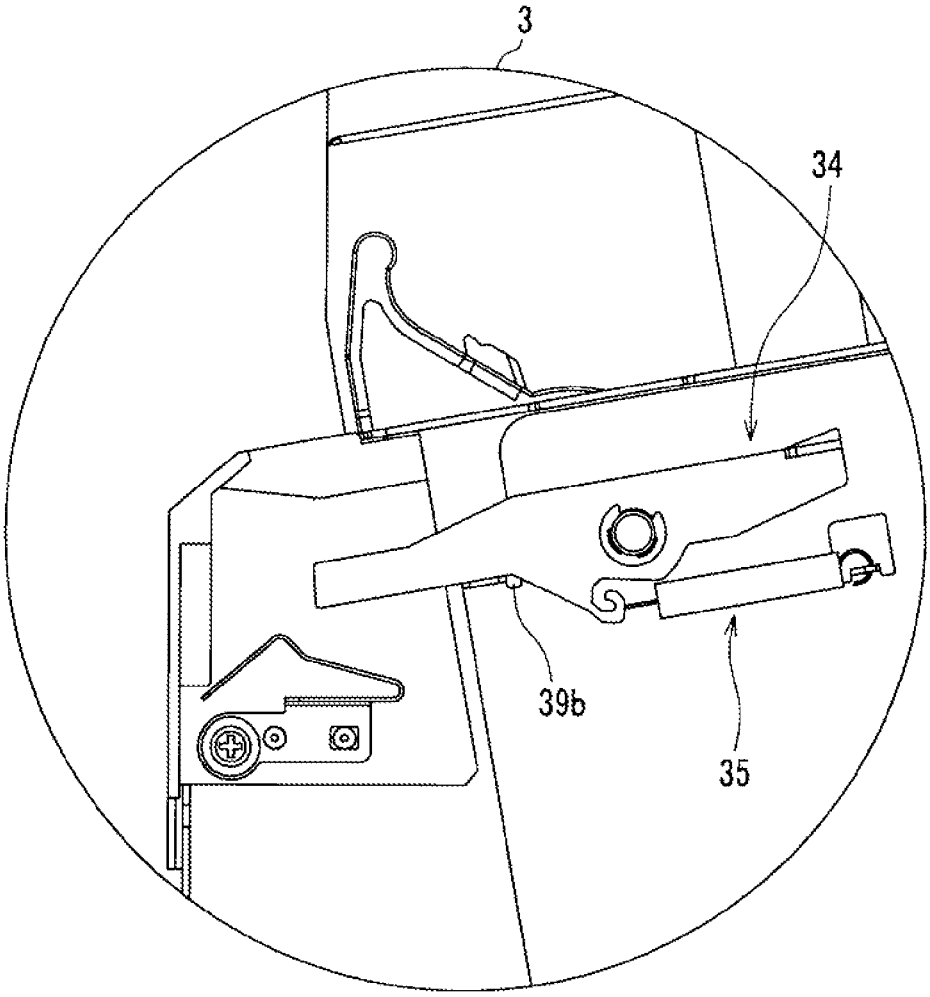
FIG. 15 is an enlarged side view of an external appearance of a main part of the image formation apparatus of the first embodiment with its front and top covers opened.

First of all, referring to FIG. 14, once front cover 40 is turned in the α2 direction in order to be put into the closed state, front cover 40 stays still in a state opened from the fully-closed position by a degrees (see FIG. 6).

Referring to FIG. 7, descriptions are provided for the operation which is carried out until this state occurs. When front cover 40 is turned in the α2 direction, projection 42*d* of protrusion 42 comes into contact with inclined portion 36*f* of plate spring 36. When the closing operation of front cover 40 is further continued, projection 42*d* goes over projection 36*d* of plate spring 36; front extremity portion 42*b* of protrusion 42 is stopped by front extremity portion 34*c* of lever 34 with its thrust; and front cover 40 stops its turn in the α2 direction (in the restricted state).

In addition, while in this state, projection 42*d* of protrusion 42 is in contact with projection 36*d* of plate spring 36, and the turn of front cover 40 in the al direction is checked as well (in the caught state). For this reason, front cover 40 cannot be closed with top cover 50 remaining unclosed.

(Closing Operation of Top Cover)

Next, referring to FIG. 6, once top cover 50 is closed by turning in an α4 direction, top cover 50 is put into the closed state shown in FIG. 10. Referring to FIG. 11, descriptions are hereinbelow provided for the operation which is carried out until this state occurs. Once top cover 50 is closed while in the restricted state, protrusion 53 presses down rear end portion 34*d* of lever 34; lever 34 turns in an α13 direction; and lever 34 is caused to stay still by protrusion 53 as the limiter.

Thereby, front cover 40 turns beyond the restricted state in the α2 direction with protrusion 42 going under front extremity portion 34*c* of lever 34, and front cover 40 becomes capable of being closed fully (see FIG. 11). The descriptions how front cover 40 and top cover 50 operate for their closing in image formation apparatus 1 of the first embodiment are concluded with this.

<<Effects of Image Formation Apparatus of First Embodiment>>

As described above, if the closing operation is carried out in the sequence in which the closing of front cover 40 is followed by the closing of top cover 50 contrary to the opening/closing sequence of the covers, opening/closing sequence regulation system 3 of the first embodiment restricts the turn of front cover 40 in the closing direction in the position (spaced-out position) where front cover 40 is opened from the closed position by α degrees (in the restricted state). This makes sure that the closing operation is carried out in the sequence in which the closing of top cover 50 is followed by the closing of front cover 40.

Furthermore, the toner cartridge installed in development unit 10K situated under front cover 40 can be replaced by opening front cover 40, because: upper extending portion 40*h* of front cover 40 is located in the position above development unit 10K (particularly, the toner cartridge); and LED head 11K is placed in the end portion of separation point 58.

Moreover, the turn of front cover 40 is restricted in the position (spaced-out position) where front cover 40 is opened from the closed position by a degrees, although upper extending portion 40*h* of front cover 40 is located in the position above development unit 10K; and LED head 11K is placed in the end portion of separation point 58. For this reason, front cover 40 does not interfere with or damage LED head 11K when top cover 50 is closed.

Besides, opening/closing sequence regulation system 3 of the first embodiment catches front cover 40 in the manner difficult to turn in the opening direction (in the caught state) in the position (spaced-out position) where front cover 40 is opened from the closed position by a degrees. For this reason, opening/closing sequence regulation system 3 can give the user of image formation apparatus 1 an impression as if front cover 40 were closed. This makes it possible to prevent the user from repeating the closing operation while forgetting that the closing operation of front cover 40 is restricted, and accordingly, prevent the repeated closing operation from leading to the destruction of front cover 40. Incidentally, while front cover 40 is in the caught state, top cover 50 can be opened/closed.

Second Embodiment

Configuration of Image Formation Apparatus of Second Embodiment

<Opening/Closing Sequence Regulation System>

Figure 16:
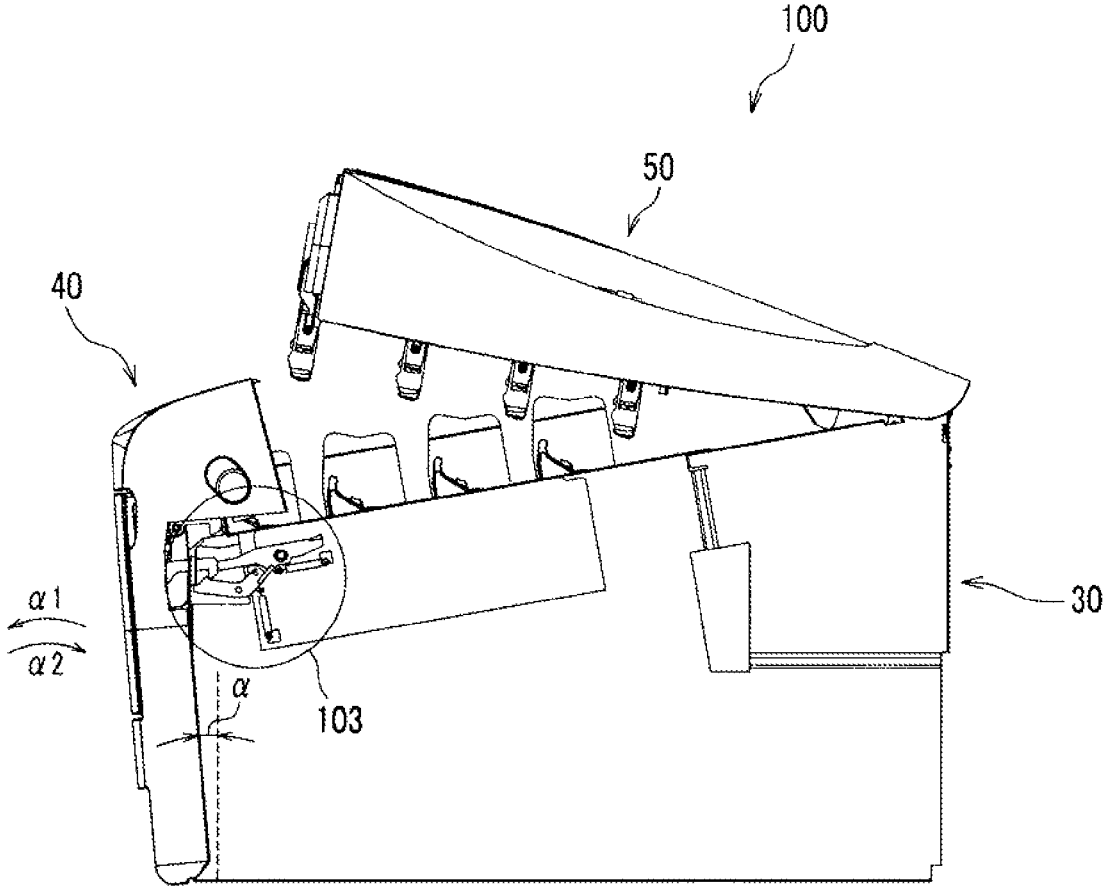
FIG. 16 is a side view of an external appearance of an image formation apparatus of a second embodiment with a closing operation of its front cover restricted, and with its top cover opened.
Figure 17:
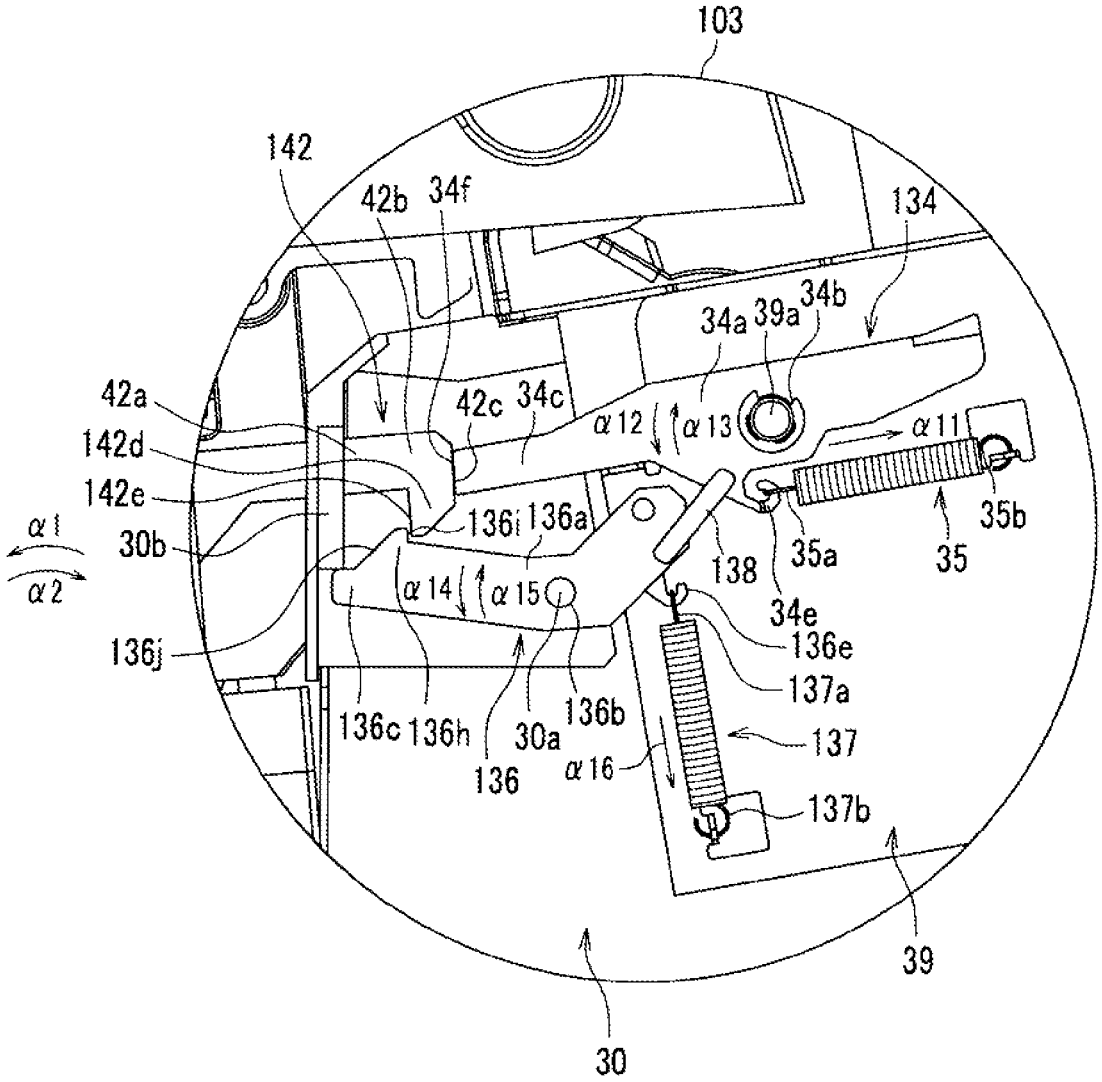
FIG. 17 is an enlarged side view of an external appearance of a main part of the image formation apparatus of the second embodiment with the closing operation of its front cover restricted, and with its top cover opened.

Next, referring to FIG. 16 and FIG. 17, descriptions are provided for opening/closing sequence regulation system 103 of the second embodiment. FIG. 16 is a side view of an external appearance of image formation apparatus 100 of the second embodiment with a closing operation of front cover 40 restricted, and with top cover 50 opened. FIG. 17 is an enlarged side view of an external appearance of a main part of the image formation apparatus 100 of the second embodiment shown in FIG. 16.

Opening/closing sequence regulation system 103 of the second embodiment includes lever 136 and tensile spring 137 in lieu of plate spring 36 (see FIG. 7) of opening/closing sequence regulation system 3 of the first embodiment. In addition, the structures of protrusion 42, lever 34 and tensile spring 35 (see FIG. 7) as the other components are modified depending on the necessity in conjunction with the use of lever 136 and tensile spring 137 in lieu of plate spring 36. The modification transforms protrusion 42 and lever 34 (see FIG. 7) into protrusion 142 and lever 134 (see FIG. 17).

To this end, each regulation mechanism of opening/closing sequence regulation system 103 of the second embodiment includes: protrusion 142 fixedly attached to front cover 40; and lever 134 as the first turnable member which is placed in plate 39 fixedly attached to housing 30; and tensile spring 35 as a first bias member. Each catch mechanism of opening/closing sequence regulation system 103 of the second embodiment includes: projection 142*d* as an engagement part which is formed in a lower portion of protrusion 142; lever 136 as a second turnable member placed on housing 30; and tensile spring 137 as a second bias member. Detailed descriptions are provided as follows.

Projection 142*d* is formed on a lateral surface of protrusion 142. Projection 142*d* comes into contact with projection 136*h* of lever 136. Incidentally, a portion of projection 142*d* which comes into contact with lever 136 is referred to as contact portion 142*e*.

An end of connection member 138 is connected to main body portion 34*a* of lever 134. Thereby, lever 134 is connected to lever 136. The turn of lever 134 in an α13 direction causes lever 136 to turn in an α14 direction by means of connection member 138.

Lever 136 is pivotally supported to be turnable about fulcrum part 30*a*, because fulcrum part 30*a* fixedly attached to housing 30 is inserted in through-hole 136*b* provided in main body portion 136*a* of lever 136. Lever 136 is connected to movable end portion 137*a* of tensile spring 137 by means of bias member 136*e*. Fixation end portion 137*b* of tensile spring 137 is fixedly attached to plate 39.

Lever 136 turns in an α15 direction due to a biasing force in an α16 direction which is produced when tensile spring 137 is pulled. It should be noted that lever 136 does not turn beyond the position shown in FIG. 17 in the α15 direction because the turn of lever 136 in the α15 direction is restricted by the contact of front extremity portion 136*c* into limiter part 30*b* formed in housing 30. One end 42*a* of protrusion 142 abuts limiter part 30*b*. In addition, lever 136 receives the biasing force which is produced by the turn of lever 134 in the α13 direction by means of connection member 138, and accordingly turns in the α14 direction.

Furthermore, projection 136*h* is formed in an upper end portion of front extremity portion 136*c* of lever 136. Projection 136*h* comes into contact with projection 142*d*. Thereby, lever 136 inhibits the turn of front cover 40 in the al direction. Incidentally, a portion of projection 136*h* which comes into contact with protrusion 142 is referred to as contact portion 136*i*.

Inclined portion 136*j* formed in the neighborhood of front extremity portion 136*c* is formed to allow projection 142*d* of protrusion 142 to easily go over projection 136*h* when front cover 40 turns in the α2 direction.

In the case where front cover 40 is closed prior to top cover 50 in a sequence which is different from the opening/closing sequence, front extremity portion 42*c* of protrusion 142 is stopped by front extremity portion 34*c* of lever 134 with its thrust. Thereby, the turn of front cover 40 in the α2 direction is restricted in the spaced-out position (see FIG. 16) which is a position where front cover 40 is opened from the fully-closed position by a degrees.

Like in the first embodiment, the angle of α degrees is that which is determined in order to prevent LED head 11K from being damaged as a result of colliding against upper extending portion 40*h* of front cover 40 when top cover 50 is closed.

By this, front extremity portion 42*b* of protrusion 142 formed in front cover 40 is stopped by front extremity portion 34*c* of lever 134 with its thrust. This restricts the turn of front cover 40 in its closing direction (the α2 direction) in the spaced-out position which is spaced out from the fully-closed position of front cover 40. The state in which the turn of front cover 40 in the closing direction (the α2 direction) is restricted is hereinafter referred to as a "restricted state."

In addition, projection 142*d* of protrusion 142 formed in front cover 40 receives the biasing force from tensile spring 137 via projection 136*h* of lever 136. Thereby, front cover 40 is caught in a manner difficult to turn in the opening direction (the al direction) in the space-out position in which the turn of front cover 40 in the closing direction (the α2 direction) is restricted. The state in which front cover 40 is caught in a manner difficult to turn in the opening direction (the al direction) is hereinafter referred to as a "caught state." In this respect, while front cover 40 (the first cover) is in the caught state, top cover 50 (the second cover) is openable/closable.

It should be noted that in this embodiment, front cover 40 may be caught in a manner difficult to turn in the opening direction (the al direction) in some position between the spaced-out position and a position immediately before the fully-closed position of front cover 40, like in the first embodiment.

Figure 18:
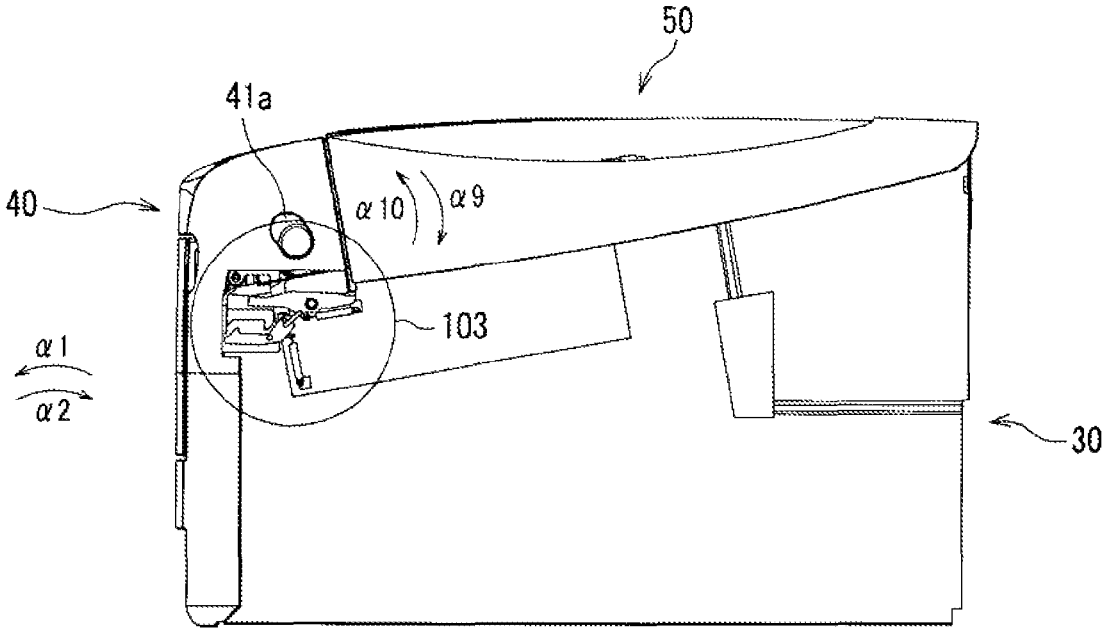
FIG. 18 is a side view of an external appearance of the image formation apparatus of the second embodiment with its front and top covers closed.
Figure 19:
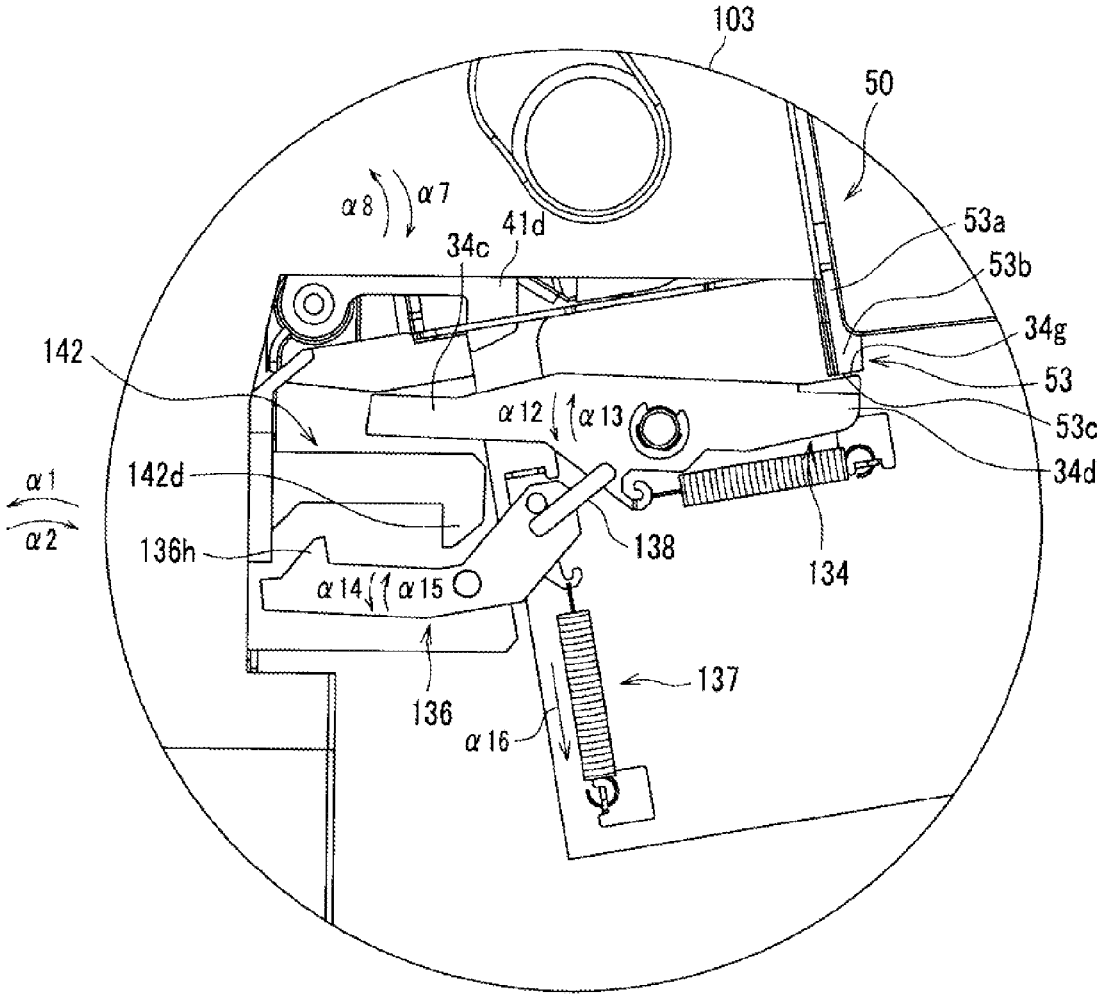
FIG. 19 is an enlarged side view of an external appearance of a main part of the image formation apparatus of the second embodiment with its front and top covers closed.

Referring to FIG. 16, the release of the restricted state is achieved by closing top cover 50. FIGS. 18 and 19 show a state where top cover 50 is closed and the caught state is released. Incidentally, FIG. 18 is a side view of an external appearance of image formation apparatus 100 of the second embodiment with front cover 40 and top cover 50 closed. FIG. 19 is an enlarged side view of an external appearance of the main part of the image formation apparatus 100 shown in FIG. 18.

Referring to FIG. 19, protrusion 53 is fixedly attached to top cover 50. Front extremity portion 53*b* of protrusion 53 comes into contact with rear end portion 34*d* of lever 134. Protrusion 53 also includes a rear extremity portion 53*a* as shown in FIG. 19. Incidentally, a portion of front extremity portion 53*b* which comes into contact with lever 134 is referred to as contact portion 53*c*, and a portion of rear end portion 34*d* which comes into contact with protrusion 53 is referred to as contact portion 34*g*.

Once top cover 50 is closed, front extremity portion 53*b* of protrusion 53 and rear end portion 34*d* of lever 134 come into contact with each other. Thereby, lever 134 receives the biasing force, and turns in the α13 direction. This causes lever 134 and protrusion 142 to come out of contact with each other, and front cover 40 is closed.

It should be noted that lever 136 turns from the position shown in FIG. 17 to the position shown in FIG. 19 in the α14 direction in conjunction with the turn of lever 134 in the α13 direction which results from the reception of the biasing force when front extremity portion 53*b* of protrusion 53 and rear end portion 34*d* of lever 134 come into contact with each other. This makes it possible to close front cover 40 with no interference between projection 142*d* of protrusion 142 and projection 136*h* of lever 136, and accordingly without any problem, when front cover 40 opens in the α1 direction. The descriptions for the configuration of the opening/closing sequence regulation system 103 of the second embodiment of the invention are concluded with this.

<<Operation of Image Formation Apparatus of Second Embodiment>>

<Opening Operation of Front and Top Covers>

Referring to FIGS. 18 to 19, descriptions are hereinbelow provided for how front cover 40 and top cover 50 operate for their opening in image formation apparatus 100 of the second embodiment.

(Opening Operation of Front Cover)

First of all, when a paper sheet jam is solved, when any development unit 10 is replaced, or when the toner cartridge or the like installed in any development unit 10 is replaced, manipulation part 41*a* of lock lever 41 is pulled up in an α10 direction. Thereby, hook parts 41*d* turn in an α8 direction, and are released from their lock. Once hook parts 41*d* are released from their lock, front cover 40 starts to turn in the al direction due to the biasing force of a torsion spring, which is not illustrated.

While top cover 50 is closed, lever 136 turns in the α14 direction, and then stays still, in conjunction with the turn of lever 134 in the α13 direction which results from the reception of the biasing force when front extremity portion 53*b* of protrusion 53 and rear end portion 34*d* of lever 134 come into contact with each other. This makes it possible to open front cover 40 with no interference between projection 142*d* of protrusion 142 and projection 136*h* of lever 136, and accordingly without any problem.

(Opening Operation of Top Cover)

Lever 34 described in the section entitled "Opening Operation of Top Cover" of the first embodiment is replaced with lever 134 to be used for the second embodiment, and lever 134 works in the same manner as does lever 34. For this reason, descriptions for the opening operation of the top cover 50 are omitted. The descriptions for how front cover 40 and top cover 50 operate for their opening in image formation apparatus 100 of the second embodiment are concluded with this.

<Closing Operation of Front and Top Covers>

Referring to FIGS. 16 and 17, descriptions are hereinbelow provided for how front cover 40 and top cover 50 operate for their closing in image formation apparatus 100 of the second embodiment. In this respect, descriptions are omitted for the closing operation carried out in a sequence in which the closing of top cover 50 is followed by the closing of front cover 40, because such a closing operation is pursued in a sequence which is reverse to the sequence described in the section entitled "Opening Operation of Front and Top Cover," which is given above. The following descriptions are provided for the closing operation carried out in a sequence in which the closing of front cover 40 is followed by the closing of top cover 50.

(Closing Operation of Front Cover)

First of all, once front cover 40 is turned in the α2 direction in order to be put into the closed state, front cover 40 stays still in a state opened from the fully-closed position by a degrees (see FIG. 16).

Referring to FIG. 17, descriptions are provided for the operation which is carried out until this state occurs. When front cover 40 is turned in the α2 direction, projection 142*d* of protrusion 142 comes into contact with inclined portion 136*j* of lever 136. When the closing operation of front cover 40 is further continued, projection 142*d* goes over projection 136*d* of lever 136; front extremity portion 42*b* of protrusion 142 is stopped by front extremity portion 34*c* of lever 134 with its thrust; and front cover 40 stops its turn in the α2 direction (in the restricted state).

In addition, while in this state, projection 142*d* of protrusion 142 is in contact with projection 136*h* of lever 136, and the turn of front cover 40 in the al direction is checked as well (in the caught state). For this reason, front cover 40 cannot be closed with top cover 50 remaining unclosed.

(Closing Operation of Top Cover)

Lever 34 and protrusion 42 described in the section entitled "Closing Operation of Top Cover" of the first embodiment is respectively replaced with lever 134 and protrusion 142 to be used for the second embodiment, and lever 134 and protrusion 142 work in the same manner as do lever 34 and protrusion 42. For this reason, descriptions for the closing operation of the top cover 50 are omitted. The descriptions for how front cover 40 and top cover 50 operate for their closing in image formation apparatus 100 of the second embodiment are concluded with this.

<<Effects of Image Formation Apparatus of Second Embodiment>>

As described above, if the closing operation is carried out in the sequence in which the closing of front cover 40 is followed by the closing of top cover 50 contrary to the opening/closing sequence of the covers, opening/closing sequence regulation system 103 of the second embodiment restricts the turn of front cover 40 in the closing direction in the position (spaced-out position) where front cover 40 is opened from the closed position by a degrees (in the restricted state). This makes sure that the closing operation is carried out in the sequence in which the closing of top cover 50 is followed by the closing of front cover 40.

Furthermore, the toner cartridge installed in development unit 10K situated under front cover 40 can be replaced by opening front cover 40, because: upper extending portion 40*h* of front cover 40 is located in the position above development unit 10K (particularly, the toner cartridge); and LED head 11K is placed in the end portion of separation point 58.

Moreover, the turn of front cover 40 is restricted in the position (spaced-out position) where front cover 40 is opened from the closed position by a degrees, even in the case where upper extending portion 40*h* of front cover 40 is located in the position above development unit 10K; and LED head 11K is placed in the end portion of separation point 58. For this reason, front cover 40 does not interfere with or damage LED head 11K when top cover 50 is closed.

Besides, opening/closing sequence regulation system 103 of the second embodiment catches front cover 40 in the manner difficult to turn in the opening direction (in the caught state) in the position (spaced-out position) where front cover 40 is opened from the closed position by a degrees. For this reason, opening/closing sequence regulation system 103 can give the user of image formation apparatus 100 an impression as if front cover 40 were closed. This makes it possible to prevent the user from repeating the closing operation while forgetting that the closing operation of front cover 40 is restricted, and accordingly to prevent the repeated closing operation from leading to the destruction of front cover 40. Incidentally, while front cover 40 is in the caught state, top cover 50 can be opened/closed.

[Modifications]

Although the foregoing descriptions are provided for the embodiments of the invention, the invention is not limited to these embodiments. The invention can be carried out within the scope which does not change the spirit of the invention. Modifications of the embodiments are shown as follows.

(Tensile Spring and Plate Spring)

Tensile spring 35 or plate spring 36 of the first embodiment, or tensile spring 137 of the second embodiment is not necessarily limited to that which is described above. An object capable of giving a certain biasing force may be used as tensile spring 35, plate spring 36 and tensile spring 137. For example, elastic bodies, such as a piece of rubber, a piece of sponge, and a spring which is neither a tensile spring nor a plate spring, may be used.

Furthermore, a pressure device in which pressure is applied to a medium may be used instead of the elastic bodies. Air, water, oil or the like may be used as the medium.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A covers opening and closing sequence regulation system comprising:

a first cover openably and closably attached to a housing;

a second cover openably and closably attached to the housing, wherein the first and second covers are configured such that the first cover becomes openable and closable while the second cover is in a fully-closed state, and that the second cover becomes unable to be fully-closed from an opened state while the first cover is in a fully-closed state; and a regulation mechanism configured to stop the first cover in a spaced-out position, being a position spaced out from a fully-closed position and a fully-opened position of the first cover, in an operation of closing the first cover toward the fully-closed position with the second cover in an opened state, wherein the second cover is openable and closable while the first cover is in the spaced-out position.

2. The covers opening and closing sequence regulation system according to claim 1, further comprising a catch mechanism configured to catch the first cover in a position between the spaced-out position and a position immediately before the fully-opened position.

3. The covers opening and closing sequence regulation system according to claim 2, wherein the catch mechanism comprises:

an engagement part formed in the first cover; and a catch part comprising a first end fixedly attached to the housing and a second opposite free end, and an engagement part between the first end and the second opposite free end and configured to engage with the engagement part of the first cover.

4. The covers opening and closing sequence regulation system according to claim 3, wherein the catch part is a plate spring.

5. The covers opening and closing sequence regulation system according to claim 1, further comprising a catch mechanism configured to catch the first cover in the spaced-out position.

6. The covers opening and closing sequence regulation system according to claim 1, wherein the regulation mechanism comprises:

a contact portion formed in the first cover;

a first turnable member including a thrust stopper, turnably attached to the housing and turnable between a restriction position and a non-restriction position, wherein the thrust stopper is configured to stop the first cover in the spaced-out position by colliding against the contact portion of the first cover in an operation of closing the first cover with the first turnable member staying in the restriction position, and to allow the first cover to be fully closed without colliding against the contact portion of the first cover in an operation of closing the first cover with the first turnable member staying in the non-restriction position; and a first bias member configured to bias the first turnable member toward the restriction position.

7. The covers opening and closing sequence regulation system according to claim 6, wherein the second cover includes a contact portion, and the contact portion of the second cover is configured to cause the first turnable member to turn to the non-restriction position against a biasing force of the first bias member in an operation of closing the second cover to the fully-closed position.

8. The covers opening and closing sequence regulation system according to claim 7, wherein the contact portion of the second cover is provided at a protrusion formed in the second cover in a position opposed to the first turnable member.

9. The covers opening and closing sequence regulation system according to claim 6, wherein the first bias member is an elastic body.

10. The covers opening and closing sequence regulation system according to claim 9, wherein the first bias member is a coil spring.

11. The covers opening and closing sequence regulation system according to claim 6, further comprising a catch mechanism that includes:

an engagement part formed in the first cover;

a second turnable member turnably attached to the housing and turnable between an engagement position and a disengagement position, the second turnable member being configured to engage with an engagement part of the first cover in the engagement position, and to disengage from the engagement part of the first cover in the disengagement position; and a second bias member configured to bias the second turnable member toward the engagement position while the second cover is in an opened state.

12. The covers opening and closing sequence regulation system according to claim 11, wherein the first bias member and the second bias member are each an elastic body.

13. The covers opening and closing sequence regulation system according to claim 12, wherein the first bias member and the second bias member are each a coil spring.

14. An image formation apparatus comprising the covers opening/closing sequence regulation system according to claim 1.

15. The image formation apparatus according to claim 14, further comprising:

a light-exposure unit configured to form an electrostatic latent image by light-exposure;

a development unit configured to form a developer image by developing the electrostatic latent image with a developer;

a transfer member configured to transfer the developer image onto a medium; and a fixation unit configured to fix the developer image to the medium.

16. The image formation apparatus according to claim 14, wherein:

the first cover is a front cover situated in a front surface of the housing, and the second cover is a top cover situated in a top surface of the housing;

the first cover comprises an upper end portion and an extended portion extending backward from the upper end portion and configured to approach a front end of the second cover;

a development unit of a predetermined color detachably attached under the extending portion inside the housing, such that the development unit for the particular color is detachable from the housing while the second cover is in a closed state and the first cover is in an opened state.

17. The image formation apparatus according to claim 16, further comprising:

a light-exposure unit configured to form an electrostatic latent image on an image carrier of the development unit, wherein the light-exposure unit is attached to an inside portion of the second cover in a vicinity of a front end of the second cover.

18. The image formation apparatus according to claim 16, further comprising:

a first lock mechanism configured to lock the first cover in the fully-closed position;

a second lock mechanism configured to lock the second cover in the fully-closed position;

a first manipulation part configured to release a locking of the first lock mechanism; and a second manipulation part configured to release a locking of the second lock mechanism, wherein the second manipulation part is hidden behind the first cover while the first cover and the second cover are in the fully-closed positions.

19. An opening and closing sequence regulation method for an apparatus including: a first cover; a second cover; and a structure configured to allow the first cover to be opened and closed while the second cover is in a fully-closed state, and not to allow the second cover to be opened or closed while the first cover is in a fully-closed state, the method comprising: stopping the first cover in a spaced-out position, which is spaced out from the a fully-closed position and a fully-opened position of the first cover, in an operation of closing the first cover toward the fully-closed position with the second cover being in an opened state, wherein the second cover is openable and closable while the first cover is in the spaced-out position.

20. The opening and closing sequence regulation method according to claim 19, further comprising:

releasing the stopping so as to enable the first cover to be fully closed, once the second cover is fully closed from the opened state while the first cover is in the spaced-out position.

* * * * *